US007975773B2

(12) United States Patent
Murata et al.

(10) Patent No.: US 7,975,773 B2
(45) Date of Patent: Jul. 12, 2011

(54) HIGH EXPANSION FOAM FIRE-EXTINGUISHING SYSTEM

(75) Inventors: Shinji Murata, Tokyo (JP); Akihiko Yokoo, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 435 days.

(21) Appl. No.: 11/987,242

(22) Filed: Nov. 28, 2007

(65) Prior Publication Data

US 2008/0128141 A1 Jun. 5, 2008

(30) Foreign Application Priority Data

Nov. 30, 2006 (JP) ..... 2006-323253
Mar. 30, 2007 (JP) ..... 2007-091277
Apr. 19, 2007 (JP) ..... 2007-110478

(51) Int. Cl.
*A62C 35/00* (2006.01)

(52) U.S. Cl. ..... 169/15; 169/14; 239/428.5; 239/432; 239/433; 239/524

(58) Field of Classification Search ..... 169/5–18; 239/428.5, 432, 433, 524
See application file for complete search history.

(56) References Cited

U.S. PATENT DOCUMENTS 3,428,131 A * 2/1969 Winslow ..... 169/15
3,780,812 A * 12/1973 Lambert ..... 169/15
4,662,454 A * 5/1987 Uchiyama et al. ..... 169/15
4,682,729 A * 7/1987 Doman et al. ..... 239/2.2
5,434,192 A * 7/1995 Thach et al. ..... 521/50
5,857,627 A * 1/1999 Horwell et al. ..... 239/428.5
2005/0045345 A1 3/2005 Arvidson et al.

* cited by examiner

*Primary Examiner* — Dinh Q Nguyen
(74) *Attorney, Agent, or Firm* — Wenderoth, Lind & Ponack, L.L.P.

(57) ABSTRACT

A high expansion foam fire-extinguishing system including: an emission nozzle (9) to which a foam solution (Wg) prepared by mixing water (W) with a foam concentrate (16) containing a surface active agent (18) is sent under pressure; a flow passage (2); and a foam screen (7) upon which the foam solution discharged from the emission nozzle impinges. The foam concentrate used is one of one in which a mixing ratio of the foam concentrate with respect to the foam solution is an adjusted mixing ratio higher than a standard mixing ratio and one in which a content rate of the surface active agent with respect to the foam concentrate is a design content rate that is higher than a standard content rate, and in which a mixing ratio of the surface active agent is a concentration for design foam expansion ratio.

4 Claims, 19 Drawing Sheets

HIGH EXPANSION FOAM FIRE-EXTINGUISHING SYSTEM

BACKGROUND OF THE INVENTION

1. Field of the Invention

The present invention relates to a high expansion foam fire-extinguishing system for use in various warehouses, hangars, plants where dangerous objects are handled, cabins, holds, etc., and more specifically, to a high expansion foam fire-extinguishing system which helps to prevent a reduction in foam expansion ratio.

2. Description of the Related Art

In a foam fire-extinguishing system, a foam solution (hereinafter also referred to simply as an "solution") is discharged from an emission nozzle, and is caused to impinge upon a foam screen to absorb air to thereby generate foam, with which the source of a fire is covered, thereby effecting a fire-extinguishing by eliminating oxygen. Such a foam fire-extinguishing system is of two types: a low foaming fire-extinguishing system and a high foaming (high expansion foam) fire-extinguishing system.

The above-mentioned two fire-extinguishing systems differ in foam expansion ratio; for example, in a low foaming fire-extinguishing system, the foam expansion ratio (multiplication) is 20 or less, and the foam is discharged from a foam head or the like so as to cover the floor surface or the like; as the foam concentrate, a aqueous film forming foam concentrate or the like is used. The foam expansion ratio of a high expansion foam fire-extinguishing system is not less than 80 but less than 1000; the foam is discharged from a foaming apparatus or the like so as to fill up the space; as the foam concentrate, a synthetic surfactant foam fire extinguishing concentrate or the like is used. Here, the term foam expansion ratio refers to the ratio in volume of the foam solution used for foam generation to the foam generated.

In order to generate high expansion foam at a foam expansion ratio, for example, of 500 or more, it is necessary to take in a large amount of air from the upstream side of the foaming apparatus (emission nozzle); when thus taking in a large amount of air, it is general practice to suck in air from outdoors (hereinafter referred to as "outside air").

However, in a system using outside air, in order to use air in the exterior, a duct is provided in the building, or a hole is formed in the partition wall to arrange a foam generator, resulting in a rather high cost, etc.

In order to solve the above-mentioned problem, there is used a high expansion foam fire-extinguishing system of a type in which the air in the area where the foam is discharged (hereinafter referred to as the "inside air") is sucked in (e.g., see JP 06-165837 A).

In an inside air type high expansion foam fire-extinguishing system, the foam expansion ratio as designed may not be attained depending upon the amount and quality of smoke generated at the time of a fire; there are cases in which, when the foam expansion ratio as designed is, for example, 500, the actual foam expansion ratio is only 100. When the foam expansion ratio is thus reduced, it becomes impossible to completely cover the fire source with the foam, with the result that the fire cannot be effectively extinguished by eliminating oxygen. As stated below, the reduction in foam expansion ratio is mainly due to the smoke in the sucked-in air.

SUMMARY OF THE INVENTION

In view of the above-mentioned problem, it is an object of the present invention to make it possible to reliably attain a desired foam expansion ratio in an inside air type high expansion foam fire-extinguishing system.

The present invention relates to a high expansion foam fire-extinguishing system including: an emission nozzle to which a foam solution prepared by mixing water with a foam concentrate containing a surface active agent is sent under pressure; a flow passage containing the emission nozzle, for sucking in air in a discharge area by discharging the foam solution from the emission nozzle; and a foam screen which is provided in the flow passage and upon which the foam solution discharged from the emission nozzle impinges, in which the foam concentrate used is one of one in which a mixing ratio of the foam concentrate with respect to the foam solution is an adjusted mixing ratio higher than a standard mixing ratio and one in which a content rate of the surface active agent with respect to the foam concentrate is a design content rate that is higher than a standard content rate, and in which a mixing ratio of the surface active agent with respect to the foam solution is a concentration for design foam expansion ratio.

The foam concentrate according to the present invention includes a aqueous film forming foam concentrate containing a fluorinated surfactant, and the aqueous film forming foam concentrate has one of an adjusted mixing ratio of 4% or more, and a concentration for design foam expansion ratio of 0.4% or more.

The foam concentrate according to the present invention includes a synthetic surfactant foam fire extinguishing concentrate containing a hydrocarbon surfactant, in which the synthetic surfactant foam fire extinguishing concentrate has one of an adjusted mixing ratio of 4% or more, and a concentration for design foam expansion ratio of 0.8% or more.

The present invention relates to a high expansion foam fire-extinguishing system which sucks air in a discharge area into a flow passage containing an emission nozzle, and which causes a solution discharged from the emission nozzle to impinge upon a foam screen to effect foaming, the high expansion foam fire-extinguishing system including a spray nozzle for spraying a fluid in a direction of interrupting the flow passage, provided between the emission nozzle and the foam screen.

An axis of the spray nozzle according to the present invention is directed in a direction orthogonal to an axis of the flow passage. An axis of the spray nozzle is inclined to one of a side of the emission nozzle and a side opposite thereto. The spray nozzle is connected to a solution supply source for the emission nozzle.

The present invention relates to a high expansion foam fire-extinguishing system which sucks air in a discharge area into a foaming portion, and which causes a solution discharged from an emission nozzle to impinge upon a foam screen to effect foaming, the high expansion foam fire-extinguishing system including a flow velocity regulating net provided on an upstream side of the foam screen adjacently thereto.

The flow velocity regulating net according to the present invention is formed to have a larger mesh than the foam screen.

The present invention relates to a high expansion foam fire-extinguishing system which sucks air in a discharge area into a foaming portion, and which causes a solution discharged from an emission nozzle to impinge upon a foaming plate to effect foaming, in which the foaming plate includes a velocity reduction foaming plate equipped with a foaming hole and a flow velocity regulating means.

The flow velocity regulating means according to the present invention includes one of a tubular protrusion, a triangular-pyramid-like protrusion, and an aperture regulating inclined member.

In the present invention, there is used a foam concentrate in which the mixing ratio of the foam concentrate with respect to the foam solution is an adjusted mixing ratio that is higher than the standard mixing ratio or in which the content rate of the surface active agent with respect to the foam concentrate is a design content rate that is higher than the standard content rate, with the mixing ratio of the surface active agent in the foam solution being the concentration for design foam expansion ratio, so even if smoke (smoke particles) is contained in the air in the discharge area, which is sucked into the flow passage, the foam solution foams at a desired foam expansion ratio. Thus, it is possible to obtain high expansion foam as designed, so it is possible to perform fire-extinguishing efficiently and reliably.

Usually, a aqueous film forming foam concentrate containing a fluorinated surfactant is mixed at the standard mixing ratio, and is used for low foam expansion ratio. This is due to the fact that the foaming property of the aqueous film forming foam concentrate is low, so the foam expansion ratio thereof at the standard mixing ratio is much lower than the foam expansion ratio of the synthetic surfactant foam fire extinguishing concentrate. However, even with this aqueous film forming foam concentrate, by attaining an adjusted mixing ratio higher than the standard mixing ratio, it is possible to obtain high foam expansion ratio. Further, the physical properties of the surface active agent are such that it exhibits low lipophilic nature except for the hydrophilic groups, and is little subject to the influence of smoke. Thus, the aqueous film forming foam concentrate can be utilized for low foam expansion ratio and high foam expansion ratio, so it is possible to enlarge the range of use thereof.

Further, in the present invention, the fluid ejected from the spray nozzle is scattered in droplets in a direction crossing the flow passage to form a flow velocity regulating curtain. Thus, the solution emitted from the emission nozzle impinges upon the curtain to thereby be reduced in velocity before impinging upon the foam screen, so foaming is effected more easily.

Further, when the solution is sprayed from the spray nozzle, the amount of solution impinging upon the foam screen to foam is of a value corresponding to the sum total of the amount of solution emitted from the emission nozzle and the amount of solution sprayed from the spray nozzle. Thus, as compared with the case in which solution is emitted solely from the emission nozzle as in the related art, it is possible to augment the foaming amount, so it is possible to effect fire-extinguishing at an early stage and with high efficiency. That is, in the case in which solution is supplied to the spray nozzle, a mist-like flow velocity regulating curtain is formed to reduce the flow velocity of the solution emitted from the emission nozzle, and it is possible to foam a larger amount of solution than in the related art.

Further, in the present invention, the foam solution ejected from the emission nozzle is inserted, after undergoing a reduction in velocity, into the mesh of a foam screen or into the foaming holes of a foaming plate. Thus, a foam film is formed more easily, thereby making it possible to prevent a reduction in foam expansion ratio.

DETAILED DESCRIPTION OF THE PREFERRED EMBODIMENTS

Figure 1:
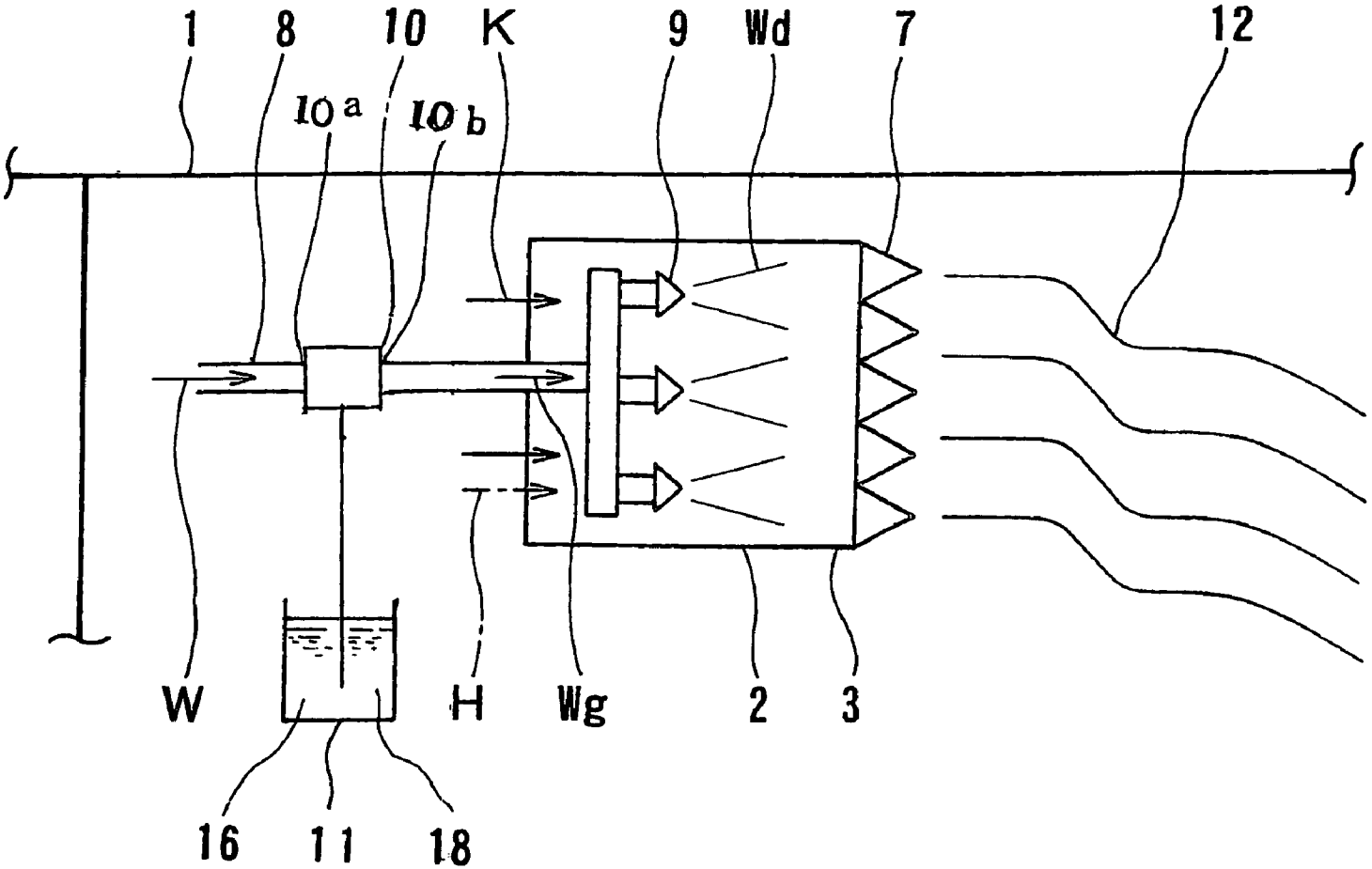
FIG. 1 is a longitudinal sectional view of an embodiment of a first invention.

The inventor of the present invention has studied the cause of the reduction in foam expansion ratio in high expansion foam fire-extinguishing systems, and has found out, through testing, that the reduction in foam expansion ratio is mainly attributable to "smoke."

The fine particles of smoke, which are generated within a room (foam discharge area) as a result of generation of a fire, float within the room as fine particles of a grain size of 1 μm or less. When those fine particles are mixed with the air in the discharge area and sucked into the air sucking portion, they are supplied to the foaming portion together with the air, thereby causing a reduction in foam expansion ratio.

While noticing that the above-mentioned problem could be solved by removing the smoke particles, the inventor of the present invention thought there might be a way of preventing a reduction in foam expansion ratio without having to remove the smoke particles.

First, a first invention will be described.

In a high expansion foam fire-extinguishing system, from the viewpoint of the performance of a foam concentrate, the cost of the foam concentrate, the equipment cost, etc., water and the foam concentrate are mixed with each other in a predetermined ratio to produce a foam solution; this predetermined ratio is in accordance with the regulations of the fire laws and the prescription in the instruction manual of the foam concentrate. In this case, the above-mentioned predetermined mixing ratio will be referred to as the "standard mixing ratio." With this standard mixing ratio, when using the air in the discharge area, it is impossible, as stated above, to attain a desired foam expansion ratio due to the influence of smoke.

The inventor of the present invention conducted a test to examine what change would occur to the foam expansion ratio if the mixing ratio of the water and the foam concentrate of the foam solution was made higher than the standard mixing ratio when supplying the foam solution to a high expansion foam fire-extinguishing system installed in a room where smoke exists.

As a result, it was found out that a mixing ratio higher than the standard mixing ratio leads to an improvement in terms of foam expansion ratio, and that, even if smoke exists, it is possible to attain a desired foam expansion ratio by adjusting the mixing ratio to a predetermined ratio. This adjusted predetermined ratio will be referred to as the "adjusted mixing ratio."

It is to be assumed that the improvement in foam expansion ratio attained through this adjusted mixing ratio is due to the fact that the concentration of the surface active agent in the foam solution, which influences the determination of the foam expansion ratio, increases to thereby cancel the action (foam expansion ratio reducing effect) of the smoke particles. More specifically, it is to be assumed that this is due to the fact that the surface active agent, contained in a ratio higher than the standard mixing ratio, foams, making up for the surface active agent that has failed to foam due to the smoke. This implies that it is possible to adjust the foam expansion ratio by controlling the surface active agent mixing ratio (concentration) in the foam solution. As is apparent from the test example described below, it has been found out that even with a aqueous film forming foam concentrate that has conventionally been regarded to be unsuited for high expansion foam fire-extinguishing systems, the foam expansion ratio can be increased through setting to the adjusted mixing ratio even if smoke is sucked in. The first invention has been made based on the above-mentioned findings. Further, the surface active agent concentration of the foam solution also allows adjustment of the foam expansion ratio through control of the content rate of the surface active agent in the foam concentrate.

Next, a second invention will be described.

Generally speaking, foam, such as high expansion foam, includes a double-layered film of the surface active agent contained in the foam stock solution, and is composed of an inner thin layer and an outer thin layer with a hydrophilic region therebetween; it is believed that the two thin films take in air to become foam-like bodies while being formed simultaneously side by side. The inventor of the present invention thought that the existence of foreign matter such as smoke particles leads to low foam expansion ratio because the formation rate of the two thin films is thereby reduced; when the emission nozzle is operated with standard setting, the velocity of the droplets of the foam solution emitted is too high, and it is impossible for the two thin films to be formed simultaneously side by side, with the foam solution being allowed to pass through the mesh.

The above-mentioned problem might be solved by setting the emission pressure lower than the standard level to reduce the emission velocity of the emission nozzle, making it harder for the droplets of the foam solution to pass through the mesh. In view of this, a test was conducted in which the ejection pressure of the emission nozzle was varied to examine the foaming condition of the foam solution of a predetermined concentration; under a smoke condition in which the foam expansion ratio is reduced to ⅕ or less of that under normal conditions at an ejection pressure of 0.5 MPa, adjusting the ejection pressure to 0.2 MPa only resulted in a reduction in foam expansion ratio to approximately ⅘.

In this way, while lowering the emission pressure of the foam solution facilitates foaming, the amount of air sucked in and the amount of foam solution emitted become smaller than those of standard setting. Thus, the foaming amount is reduced, and it is impossible to achieve a desired foaming amount within a predetermined period of time.

In view of this, the inventor of the present invention conducted study and test to solve the above problem, finding out that provision of a spray nozzle between the emission nozzle and the foam screen helps to solve the problem. That is, it was found out that the above-mentioned problem can be solved by forming a flow velocity regulating curtain through spraying of the fluid from the spray nozzle and causing the droplets of the foam solution emitted from the emission nozzle to impinge upon the curtain to thereby achieve a reduction in flow velocity. The second invention has been made based on the above finding.

Further, a third invention will be described.

The inventor of the present invention made an attempt to solve the above-mentioned problem by reducing the velocity of the droplets of the foam solution by means of a flow velocity regulating net or a flow velocity regulating means such as a foaming plate. The third invention has been made based on the above finding.

First, an embodiment of the first invention will be described with reference to FIGS. 1 and 2.

Within a room 1 constituting a foam discharge area, there is provided a high expansion foam fire-extinguishing system. This fire-extinguishing system is a foaming apparatus equipped with a flow passage 2, and its foam expansion ratio is set, for example, at 500. The flow passage 2 is equipped with a foaming portion 3 (foam generating portion 3) adapted to suck in the air in the discharge area 1 through driving of emission nozzles 9 to thereby foam a foam solution.

A foam screen 7 (foam generating screen 7) is provided at the foaming portion 3, which is at the forward end of the flow passage 2, within which there are provided a plurality of emission nozzles 9 opposed to the foam screen 7 at an interval. This foaming apparatus is constructed so as to be supplied with a foam solution and air according to the foam expansion ratio. The emission nozzles 9 are connected to a water supply source (not shown) through a water supply pipe 8.

The water supply pipe 8 is provided with a mixing device (proportioner) 10, which has a negative pressure generating portion (not shown) connected to a foam stock solution tank 11. The tank 11 is filled with a foam concentrate (foam stock solution) 16.

The foam concentrate 16 is a aqueous film forming foam concentrate whose main ingredient is a fluorinated surfactant 18, such as MEGAFOAM F-623T (registered trademark). The foam concentrate 16 also contains ingredients for maintaining its performance, such as freeze prevention agent and stabilizing agent. While the standard mixing ratio of the foam concentrate 16 is, for example, 3% (standard content rate), it is used, in this example, at an adjusted mixing ratio (design content rate) which is higher than the standard mixing ratio. For example, 10% is selected as the adjusted mixing ratio.

The content rate of the fluorinated surfactant 18 with respect to the aqueous film forming foam concentrate 16 is, for example, 10%. Thus, the mixing ratio of the surface active agent 18 at the standard mixing ratio (3%) with respect to the foam solution Wg is 0.03×0.1=0.003, which means a concentration of 0.3%, and the mixing ratio of the surface active agent 18 at the adjusted mixing ratio (10%) with respect to the foam solution Wg is 0.1×0.1=0.01, which means a concentration of 1%. Here, the standard content rate of the fluorinated surfactant 18 with respect to the aqueous film forming foam concentrate 16 is 10%; when this content rate is increased, and a concentrate of a design content rate of, for example, 3.3 times the same, is used, it is also possible for the mixing ratio of the surface active agent 18 to be approximately 1% when the mixing ratio is 3%.

Figure 2:
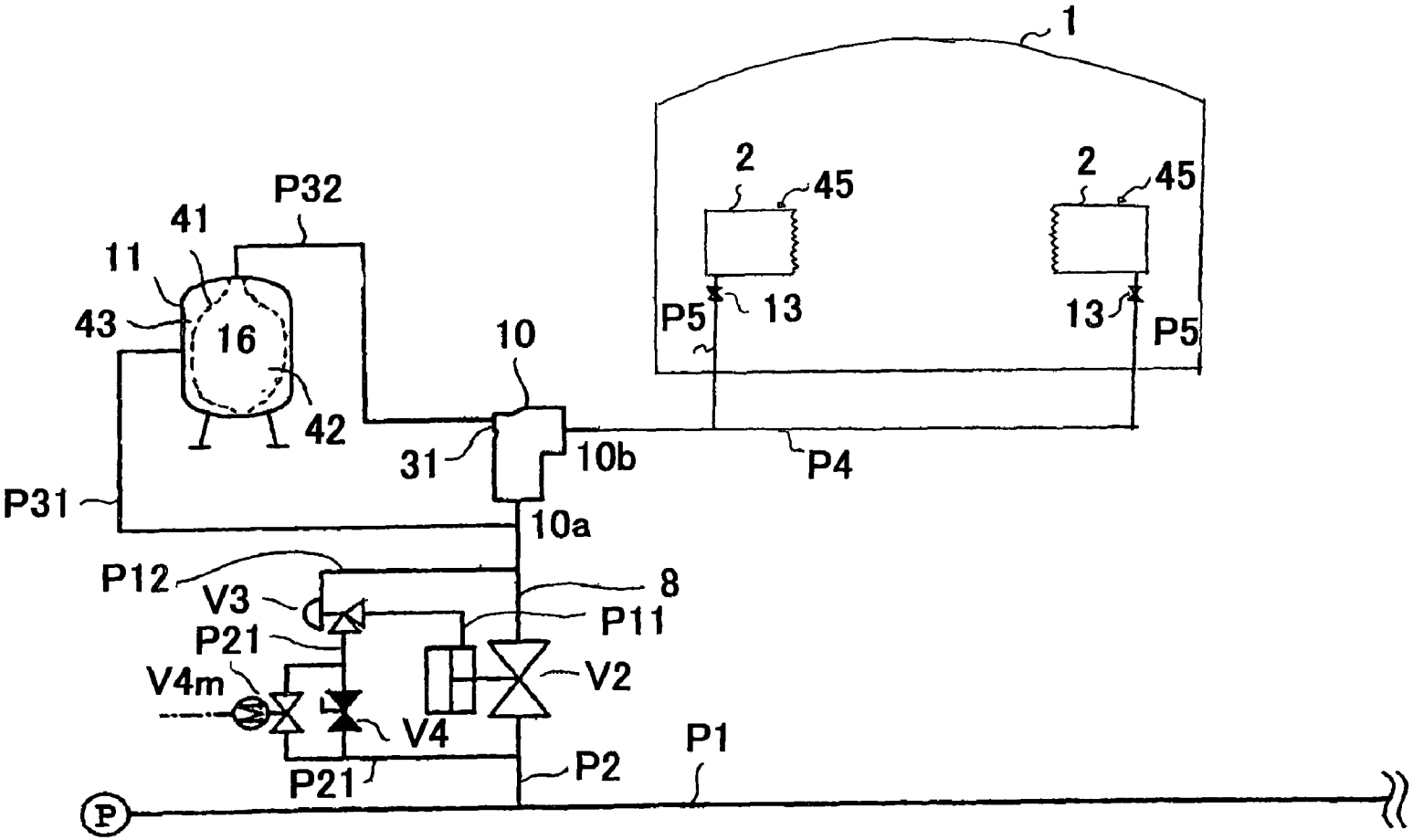
FIG. 2 is a schematic view illustrating the general construction of a high expansion foam fire-extinguishing system according to an embodiment of the first invention.

FIG. 2 is a schematic view showing the general construction of a high expansion foam fire-extinguishing system.

Symbol P indicates a pressurizing device, symbol P1 indicates a main pipe for sending water W (fire-extinguishing water W) sent under pressure from the pressurizing device P, symbol P2 indicates primary side piping, symbol V2 indicates a pressure regulating valve including, for example, a simultaneous opening valve endowed with a pressure regulating function, numeral 8 indicates the water supply pipe 8 as secondary side piping, symbol V3 indicates a pressure regulating pilot valve, symbol V4 indicates a start valve, symbol V4*m* indicates a remote-control start valve connected in parallel to the start valve V4 and adapted to be opened and closed by a signal from a control panel (not shown), numeral 10 indicates a mixing device whose inlet portion 10*a* is connected to the water supply pipe 8, that is, connected to the secondary side of the pressure regulating valve V2, and which has a foam stock solution pouring port 31, and numeral 11 indicates a foam stock solution tank in which a stock solution chamber 42 connected to the foam stock solution pouring port 31 of the foam mixing device 10 through foam stock solution piping P32 and storing the foam concentrate 16 (foam stock solution 16) and a water chamber 43 connected to the primary side of the foam mixing device 10 through the water supply piping P31 are separated from each other by a membrane 41.

Symbol P4 indicates solution piping connected to the secondary side of the foam mixing device 10 and adapted to send the foam solution Wg, symbol P5 indicates a branch pipe branching off from the piping P4, numeral 45 indicates a foaming apparatus supplied with the foam solution Wg from the foam mixing device 10 through the piping P4 and the branch pipe P5 and equipped with the flow passage 2 for ejecting the solution from the emission nozzles 9 to effect foaming, numeral 13 indicates a selection valve provided in the branch pipe P5 and serving as an opening/closing mechanism adapted to be opened/closed through remote control from the control panel (not shown), and numeral 1 indicates the room constituting the discharge area in which the foaming apparatus 45 is installed.

Next, the operation of the embodiment of the first invention will be described.

When a fire occurs in the room 1, a fire sensor (not shown) detects the fire, and sends a fire signal to the control panel. Then, the control panel starts the high expansion foam fire-extinguishing system, so the air in the room, that is, the air K in the room (discharge area) 1 containing smoke H where the flow passage 2 is arranged, is sucked into the foaming portion 3 of the flow passage 2.

The water W flowing through the water supply pipe 8 flows into the downstream portion of the water supply pipe 8 through an inlet portion 10*a* of the mixing device 10, the negative pressure generating portion, and an outlet portion 10*b*, with negative pressure being generated in the negative pressure generating portion. Thus, due to the negative pressure of the negative pressure generating portion, the foam concentrate 16 in the foam stock solution tank 11 is sucked into the mixing device 10, and is mixed with the water W, whereby the foam solution Wg is generated. At this time, the mixing ratio of the foam concentrate 16 with respect to the foam solution Wg is the above-mentioned adjusted mixing ratio, which is, for example, 10%, and the mixing ratio, i.e., the concentration, of the fluorinated surfactant 18 with respect to the foam solution Wg is a concentration, for example, of 1%. This mixing ratio is a concentration for obtaining a desired foam expansion ratio of, for example, 500; here, this concentration will be referred to as the "concentration for design foam expansion ratio."

The foam solution Wg is sent under pressure through the water supply pipe 8 to the emission nozzles 9, and is emitted from the emission nozzles 9. The emitted foam solution Wg is turned into droplets Wd, which impinge upon the foam screen 7 to foam while taking in the air K, forming high expansion foam 12. The foam expansion ratio at this time is the desired design foam expansion ratio, which is, for example, 500. The high expansion foam 12 thus generated and discharged is accumulated in and fills up the room 1.

The above-mentioned aqueous film forming foam concentrate is intended for low foam expansion ratio, and is usually used so as to cover a floor surface or the like at low foam expansion ratio. However, by utilizing the present invention, the above-mentioned aqueous film forming foam concentrate can also be used for foaming at high foam expansion ratio. While a foam expansion ratio of 500 or more is desirable for use in a so-called total area emission type fire-extinguishing system, in which the room 1 is filled up with high expansion foam 12, a foam expansion ratio lower than that, e.g., 300 or more, may also be adopted. The mixing ratio of the foam concentrate 16 with respect to the foam solution Wg is 7% or more, and the mixing ratio of the fluorinated surfactant 18 with respect thereto is 0.7% or more.

The above operation will be described in more detail with reference to FIG. 2.

When a fire occurs in the room 1, a fire sensor (not shown) detects the fire, and transmits a fire signal to the control panel. When a start signal for the foam fire-extinguishing system is output from the control panel based on judgment made by emergency personnel or automatically, it reaches the remote-control start valve V4*m*, the pressurizing device P, and the selection valve 13 to start the system.

When the remote-control start valve V4*m* is opened, the primary pressure increased by the pressurizing device P reaches from the primary side piping P2 to an accumulating chamber (not shown) of the pressure regulating valve V2 via the remote-control start valve V4*m*, the pressure regulating pilot valve V3, and piping P11 to thereby open the pressure regulating valve, which is in a closed state at the time of vigilance (the function of a simultaneous opening valve). No detailed illustration is given of the fluctuations in the pressure of the water supply pipe 8, to which the pressure due to pressure extraction piping P12 is to be supplied, when the water supply pipe 8 is filled with water, but its pressure is adjusted so as to approximate a set pressure set by the pressure regulating pilot valve V3.

When the fire-extinguishing water W having passed through the pressure regulating valve V2 passes through the mixing device 10, the fire-extinguishing water W also flows into the water supply piping P31 to supply water to the water chamber 43. The amount of fire-extinguishing water thus supplied is caused so as to push out the foam stock solution 16 in the stock solution chamber 42 via the membrane 41 and poured into the foam stock solution pouring port 31 through the foam stock solution piping P32. In this way, the foam mixing device 10 mixes the foam stock solution 16 and the fire-extinguishing water W with each other at a fixed ratio.

At this time, the pouring of the foam stock solution 16 into the mixing device 10 is effected so as to avoid mixing by pushing it out by a membrane system using the fire-extinguishing water W on the primary side which is at a pressure equal to the pressure at which water is supplied to the mixing device 10, so little energy loss is involved regarding the suction of the foam stock solution 16, and the pressure loss involved is small. Further, when there is provided the foam mixing device 10 as shown in FIG. 2, to which the foam stock solution tank 11 with the membrane 41 belongs, the solution passes through the foam mixing device 10 of relatively small pressure loss, so it is possible to attain a nozzle pressure involving a relatively small error with respect to the design value, making it possible to obtain a stable foaming performance and fire-extinguishing performance.

After the passing of the solution through the foam mixing device 10, the selection valve 13 corresponding to the foaming apparatus 45 required to perform foaming is opened, and the foam solution Wg is ejected toward the foam screen 7 from the emission nozzles 9 in the foaming apparatus 45.

Next, first and second test examples of the first invention will be described.

First Test Example

In the high expansion foam fire-extinguishing system of the above-mentioned embodiment, a test was conducted under the following conditions, in which foaming was effected, with the mixing ratio of the MEGAFOAM F-623T (registered trademark) being higher than the standard mixing ratio (the adjusted mixing ratio), and the mixing ratio of the fluorinated surfactant with respect to the foam solution being the concentration for design foam expansion ratio. The test results are as shown in Table 1, in which the column of foam concentrate (%) shows adjusted mixing ratios, the column of fluorinated surfactant concentration (%) shows concentrations for design foam expansion ratio, and the column of foam expansion ratio shows actual foam expansion ratios.

As is apparent from Table 1, when, for example, the adjusted mixing ratio was 4.0%, the concentration for design foam expansion ratio was 0.4%, and the foam expansion ratio was 240, thus making it possible to obtain a desired high foam expansion ratio.

Foam expansion ratio in Mosquito-Repellent Incense Smoke Test conditions: smoke density (extinction ratio): 15 to 20%/m room temperature: 10 to 20° C.

foaming apparatus: 0.5 MPa, 40 L/min foam discharge area: 4 m×4 m×2 m

TABLE 1

| foam concentrate (%) | concentration for fluorinated surfactant (%) | foam expansion ratio (multiplication) |
|---|---|---|
| 4.0 | 0.4 | 240 |
| 6.6 | 0.66 | 272 |
| 7.0 | 0.7 | 300 |
| 8.3 | 0.83 | 400 |
| 10.0 | 1.0 | 500 |
| 13.5 | 1.35 | 666 |

Second Test Example

In the second test example, instead of a aqueous film forming foam concentrate, a synthetic surfactant foam fire extinguishing concentrate was used as the foam concentrate, and a foaming test was conducted in the same manner as described above under the same test conditions as those of the first test example described above.

As the synthetic surfactant foam fire extinguishing concentrate, there was used SNOWRAP H (registered trademark) whose main ingredient is a hydrocarbon surfactant; the standard mixing ratio of this foam concentrate is 3%. The test results are as shown in Table 2, in which the column of foam concentrate (%) shows adjusted mixing ratios, the column of hydrocarbon surfactant concentration (%) shows concentrations for design foam expansion ratio, and the column of foam expansion ratio shows actual foam expansion ratios.

As is apparent from Table 2, when, for example, the adjusted mixing ratio was 4.0%, the concentration for design foam expansion ratio was 0.8%, and the foam expansion ratio was 110, thus making it possible to obtain a desired high foam expansion ratio.

TABLE 2

| foam concentrate (%) | concentration for hydrocarbon surfactant (%) | foam expansion ratio (multiplication) |
|---|---|---|
| 3.0 | 0.6 | 82 |
| 4.0 | 0.8 | 110 |
| 8.0 | 1.6 | 210 |
| 14.0 | 2.8 | 300 |
| 18.0 | 3.6 | 375 |
| 21.0 | 4.2 | 500 |
| 22.5 | 4.5 | 555 |
| 25.0 | 5.0 | 600 |

As described above, even if smoke exists in the discharge area, by adjusting the mixing ratio of the aqueous film forming foam concentrate to 4% or more, or by adjusting the mixing ratio of the fluorinated surfactant to 0.4% or more, with respect to the foam solution, a foam expansion ratio of 240 or more is attained, thus making it possible to obtain high expansion foam. Further, by adjusting the mixing ratio of the aqueous film forming foam concentrate to 7% or more, or by adjusting the mixing ratio of the fluorinated surfactant to 0.7% or more, a foam expansion ratio of 300 or more is attained, thus making it possible to obtain high expansion foam that can be used in a total area emission type fire-extinguishing system.

Here, when the mixing ratio of the aqueous film forming foam concentrate is set to 10% or more, or the mixing ratio of the fluorinated surfactant is set to 1% or more, a foam expansion ratio of 500 or more is attained, thus providing an optimum foam expansion ratio for a total area emission type system.

Further, even if smoke exists in the discharge area, by adjusting the mixing ratio of the synthetic surfactant foam fire extinguishing concentrate to 4% or more, or by adjusting the mixing ratio of the hydrocarbon surfactant to 0.8% or more, with respect to the foam solution, a foam expansion ratio of 110 or more is attained, thus making it possible to obtain high expansion foam. Further, by adjusting the mixing ratio of the synthetic surfactant foam fire extinguishing concentrate to 14% or more, or by adjusting the mixing ratio of the hydrocarbon surfactant to 2.8% or more, a foam expansion ratio of 300 or more is attained, thus making it possible to obtain high expansion foam that can be used in a total area emission type high expansion foam fire-extinguishing system.

Here, when the mixing ratio of the synthetic surfactant foam fire extinguishing concentrate is set to 21% or more, or the mixing ratio of the hydrocarbon surfactant is set to 4.2% or more, a foam expansion ratio of 500 or more is attained, thus providing an optimum foam expansion ratio for a total area emission type system.

The above-mentioned embodiment of the first invention is not limited to be construed restrictively; for example, it goes without saying that it is possible to use, as the foam concentrate whose main ingredient is a surface active agent, some other foam concentrate than the aqueous film forming foam concentrate and the synthetic surfactant foam fire extinguishing concentrate mentioned above.

Next, a first embodiment of the second invention will be described with reference to FIGS. 3 and 4.

The first embodiment of the second invention differs from the embodiment of the first invention in the construction of the foaming apparatus (foam generator of this embodiment); otherwise, it is substantially of the same system construction as the above embodiment.

A high expansion foam fire-extinguishing system is provided in the room (chamber) 1 constituting the foam discharge area. This fire-extinguishing system is a foam generator equipped with the flow passage 2, with the foam expansion ratio thereof being set to 500. Inside the flow passage 2, there is provided the foaming portion 3 adapted to suck in the air of the discharge area 1.

At the foaming portion 3 at the forward end of the flow passage 2, there is provided the foam screen (screen) 7, on the inner side of which there are provided a plurality of emission nozzles 9 opposed to the foam screen 7 at an interval. The emission nozzles 9 are connected to a solution supply source (mixing device) (not shown) for producing a foam solution (solution), which is a mixture solution of a foam stock solution (foam concentrate) and water.

Between the foam screen 7 and the emission nozzles 9, there are provided a plurality of spray nozzles 50, which are arranged circumferentially at equal intervals, with center of the axes 50*c* of the spray nozzles being directed in directions orthogonal to center of the axis 2*c* of the flow passage 2.

For the spray nozzles 50, there are used, for example, four sector-shaped nozzles. However, their configuration, number, etc. can be freely selected as long as they can form a mist-like flow velocity regulating curtain FC. The spray nozzles 50 communicate with the solution supply source of the emission nozzles 9.

Next, the operation of the first embodiment of the second invention will be described.

When a fire occurs in the room 1, a fire sensor (not shown) detects the fire, and sends a fire signal to the control panel. Then, the control panel starts the high expansion foam fire-extinguishing system, so the air in the room, that is, the air K in the room (discharge area) 1 containing smoke H where the flow passage 2 is arranged, is sucked into the foaming portion 3 of the flow passage, and the solution Wg is discharged in droplets from the emission nozzles 9.

At this time, since the foam solution Wg is sprayed from the spray nozzles 50, a mist-like flow velocity regulating curtain FC is formed in the flow passage 2. The curtain FC is formed so as to interrupt the flow passage, constituting a curtain in which the droplets are distributed substantially uniformly and which has a fixed thickness. Thus, the droplets of the solution emitted from the emission nozzles 9 impinge upon the curtain FC to be reduced in velocity, and then impinge upon the foam screen 7 to enter the mesh thereof, with the entering velocity being lower than that in the conventional example (i.e., in the case in which no spray nozzles 50 are provided). Thus, foaming is effected easily, so it is possible for the droplets of the solution to form the high expansion foam 12 with high efficiency.

As described above, the foam solution Wg sprayed from the spray nozzles 50 forms the mist-like flow velocity regulating curtain FC; the droplets of the foam solution Wg are drawn by the droplets of the solution Wg emitted from the emission nozzles 9 to impinge upon the foam screen 7 of the foaming portion 3, thereby effecting foaming. Thus, the total supply amount of solution in this fire-extinguishing system is the sum total of the amount of solution from the emission nozzles 9, which is, for example, 40 L, and the amount of solution from the spray nozzles 50, which is, for example, 20 L, that is, 60 L. Thus, as compared with the prior-art example, the supply amount of solution is increased, so the foaming amount is increased, making it possible to attain a fire-extinguishing effect at an early stage. Further, even in the case, for example, of an ordinary 40 L type foam fire-extinguishing system (foam generator), it is possible to attain the performance of a 60 L type foam fire generator through the provision of the spray nozzles. As a result, the number of foam generators arranged can be reduced as compared with the related art.

Figure 3:
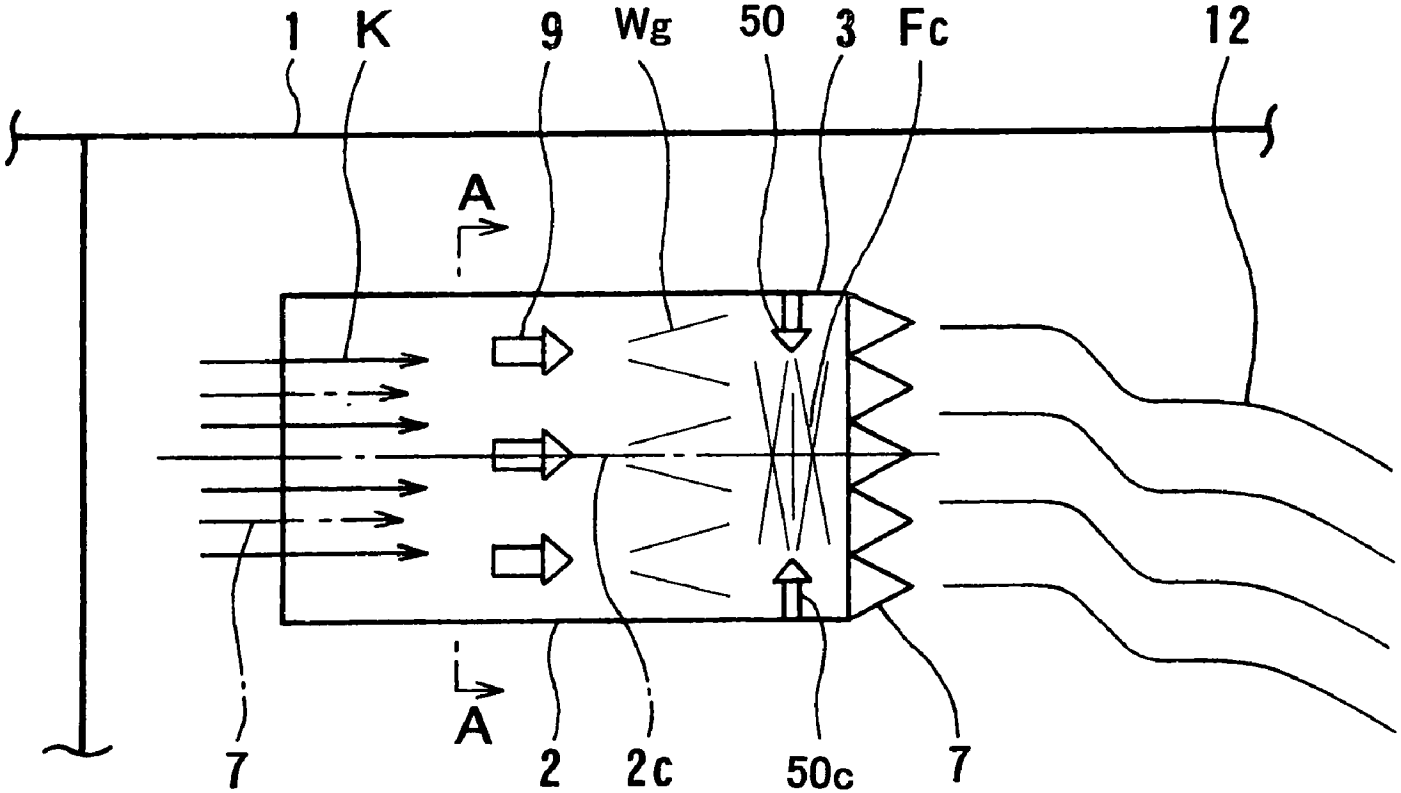
FIG. 3 is a longitudinal sectional view of a first embodiment of a second invention.
Figure 4:
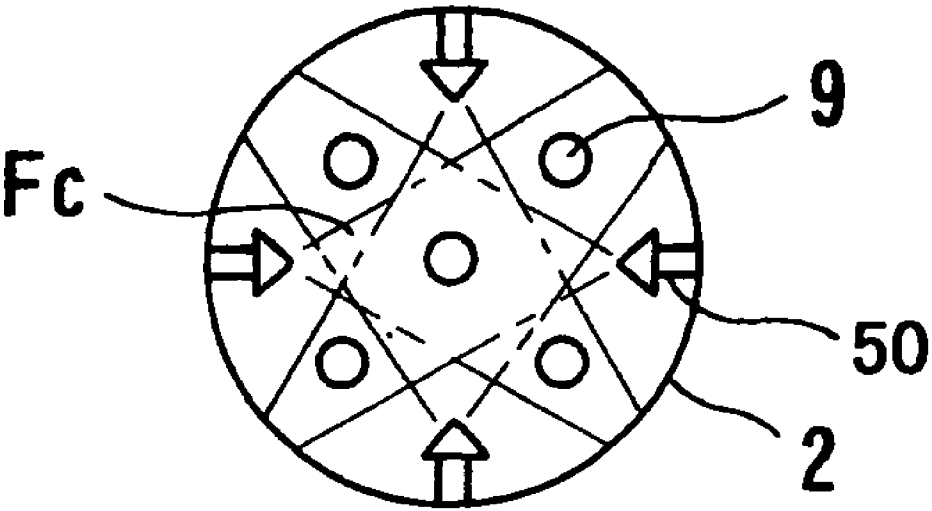
FIG. 4 is a sectional view taken along the line A-A of FIG. 3.
Figure 5:
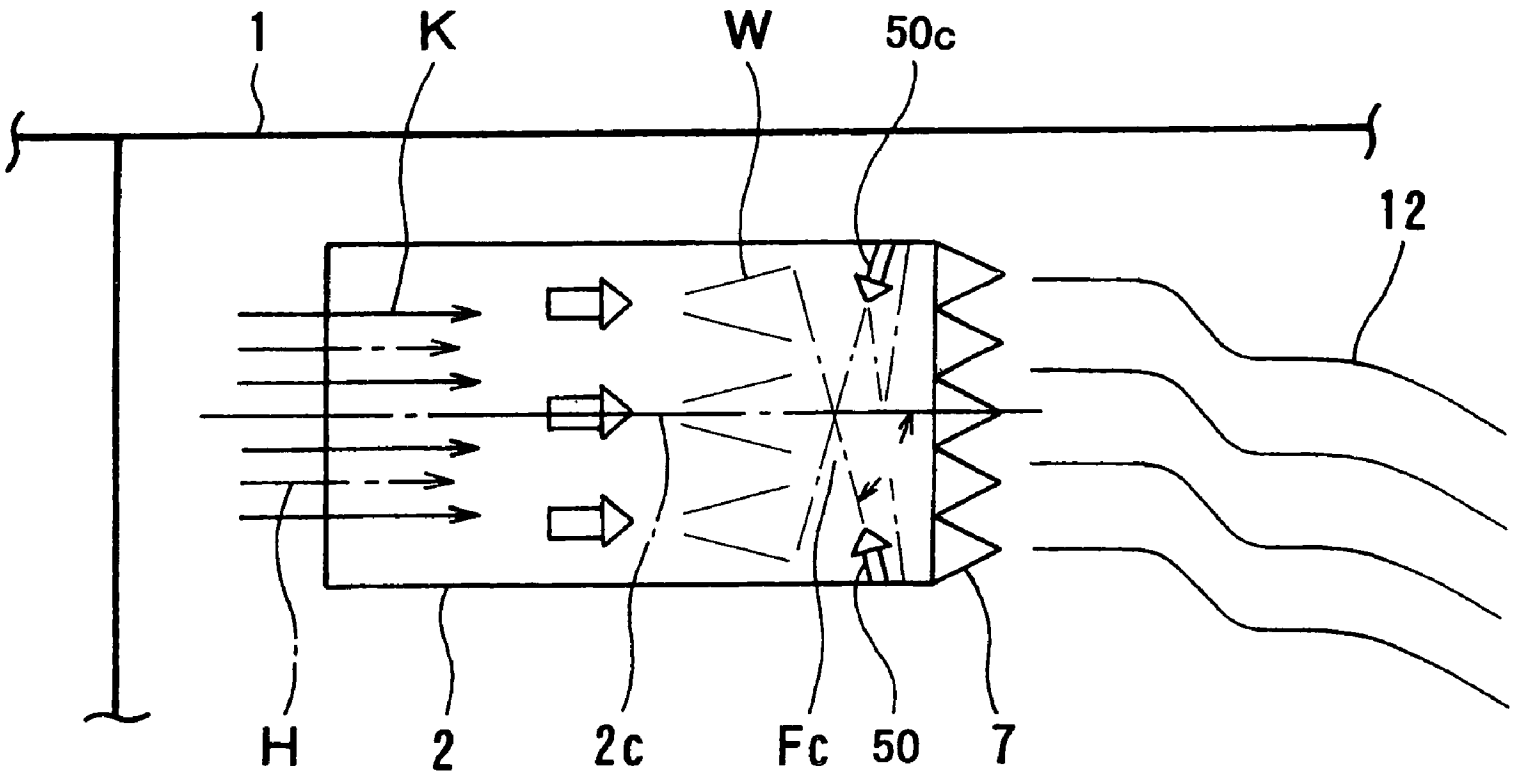
FIG. 5 is a longitudinal sectional view corresponding to FIG. 3, showing a second embodiment of the second invention.

A second embodiment of the second invention will be described with reference to FIG. 5; the portions indicated by the same reference symbols as those of FIGS. 3 and 4 are the same in terms of denomination and function.

The second embodiment differs from the first embodiment in the directions of the axes of the spray nozzles and in the fluid supplied to the spray nozzles.

The axes 50*c* of the spray nozzles 50 are inclined toward the emission nozzles 9, and cross the axis 2*c* of the flow passage 2 at an inclination angle θ. Due to this inclination, the fluid from the spray nozzles 50 is ejected toward the droplets of the solution Wg emitted from the emission nozzles 9, so it is possible to achieve an improvement in terms of the flow velocity regulating effect as compared with the first embodiment described above. The inclination angle θ allows selection appropriately as needed.

Further, if deceleration can be made, it is also possible for the axes 50*c* of the spray nozzles 50 to be inclined in the opposite direction, that is, toward the side opposite to the emission nozzles 9.

As the fluid to be supplied to the spray nozzles 50, it is also possible to use, instead of the solution (foam solution), water or an inert gas such as nitrogen, carbon dioxide, or argon. When the water is used, the foam solution emitted from the emission nozzles is diluted, so the foam solution used should preferably be a one that is of a somewhat higher concentration.

Further, the pressure of the fluid supplied to the emission nozzles is higher than the pressure of the fluid supplied to the spray nozzles; for example, the former is set to 0.5 $MPa/cm^2$, and the latter is set to 0.20 $MPa/cm^2$. Those pressures, however, allow selection appropriately as needed.

Next, a first embodiment of a third invention will be described with reference to FIGS. 6 and 7.

The first embodiment of the third invention differs from the embodiment of the first invention in the construction of the foaming apparatus; otherwise, it is substantially of the same system construction as the above embodiment.

A high expansion foam fire-extinguishing system is provided in the room (chamber) 1 constituting the foam discharge area. In this fire-extinguishing system, the foam expansion ratio is set, for example, at 500, and there is provided the foaming portion 3 adapted to suck in the air of the discharge area 1.

The foaming portion 3 is formed in a tubular configuration, and has at its forward end the foam screen (screen) 7. Within the foaming portion, there are provided a plurality of emission nozzles 9 opposed to the foam screen 7 at an interval. The emission nozzles 9 are connected to the mixing device (not shown) for producing a foam solution.

On the upstream side of the foam screen 7, there is provided a flow velocity regulating net 60 so as to be adjacent thereto. The size of the mesh of the flow velocity regulating net 60 is larger than that of the foam screen 7; the size, however, allows selection appropriately as needed.

Figure 7:
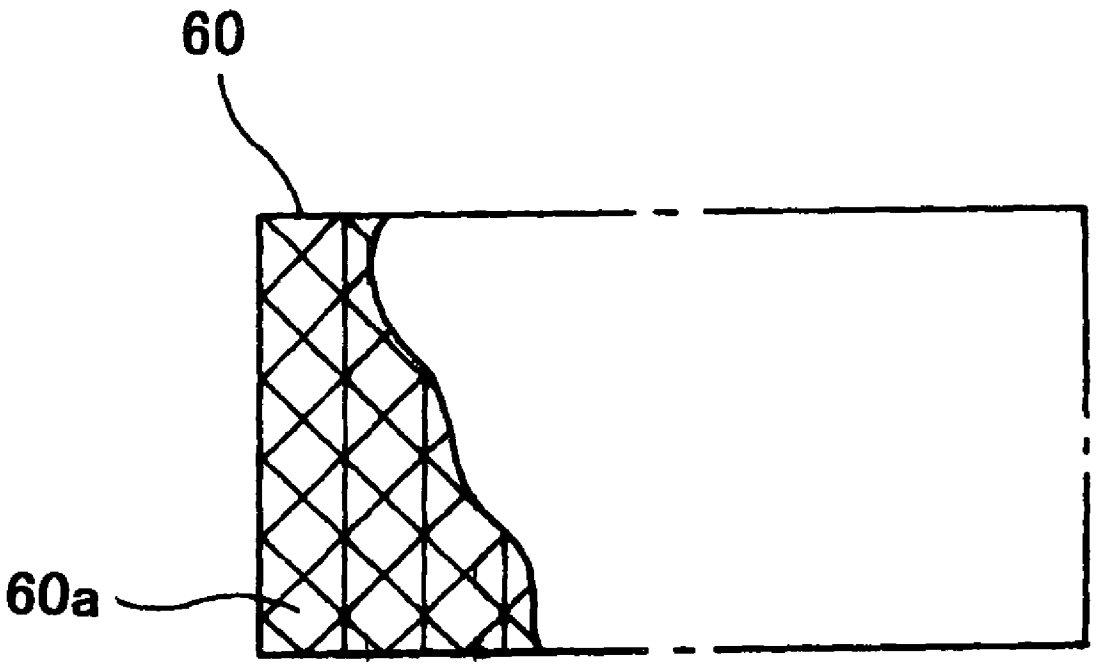
FIG. 7 is a plan view of a flow velocity regulating net.

As shown in FIG. 7, the flow velocity regulating net 60 is formed to be similar to the foam screen 7 by bending a single wire net in a corrugated fashion. The configuration of the flow velocity regulating net 60, however, allows selection appropriately as needed. Further, the flow velocity regulating net 60 is spaced apart from foam screen 7 by a gap t, the size of which allows selection appropriately as needed.

Next, the operation of the first embodiment of the third invention will be described.

When a fire occurs in the room 1, a fire sensor (not shown) detects the fire, and sends a fire signal to the control panel. Then, the control panel starts the high expansion foam fire-extinguishing system, so the air in the room, that is, the air K in the vicinity of the portion of the room (discharge area) 1 where the foaming portion 3 is arranged, is sucked into the foaming portion 3, and a foam solution (also referred to simply as the "solution") Wg is discharged in droplets from the emission nozzles 9.

The droplets impinge upon the flow velocity regulating net 60 to be reduced in velocity, and then impinge upon the foam screen 7 through the mesh 60*a* to enter the mesh of the screen 7, with the entering velocity being lower than that in the conventional example. Thus, foaming is effected more easily, so it is possible for the droplets of the foam solution to form the high expansion foam 12 with high efficiency.

Another effect attained through the installation of the flow velocity regulating net 60 is that the droplets are caused to undergo collision and foaming twice. More specifically, a part of the droplets foam by impinging upon the flow velocity regulating net 60, and a part of the droplets that have not foamed yet pass through the mesh 60*a* to impinge upon the foam screen 7, thereby foaming. Thus, the number of times that the droplets undergo foaming is increased, making it possible to form the high expansion foam 12 with high efficiency.

Figure 6:
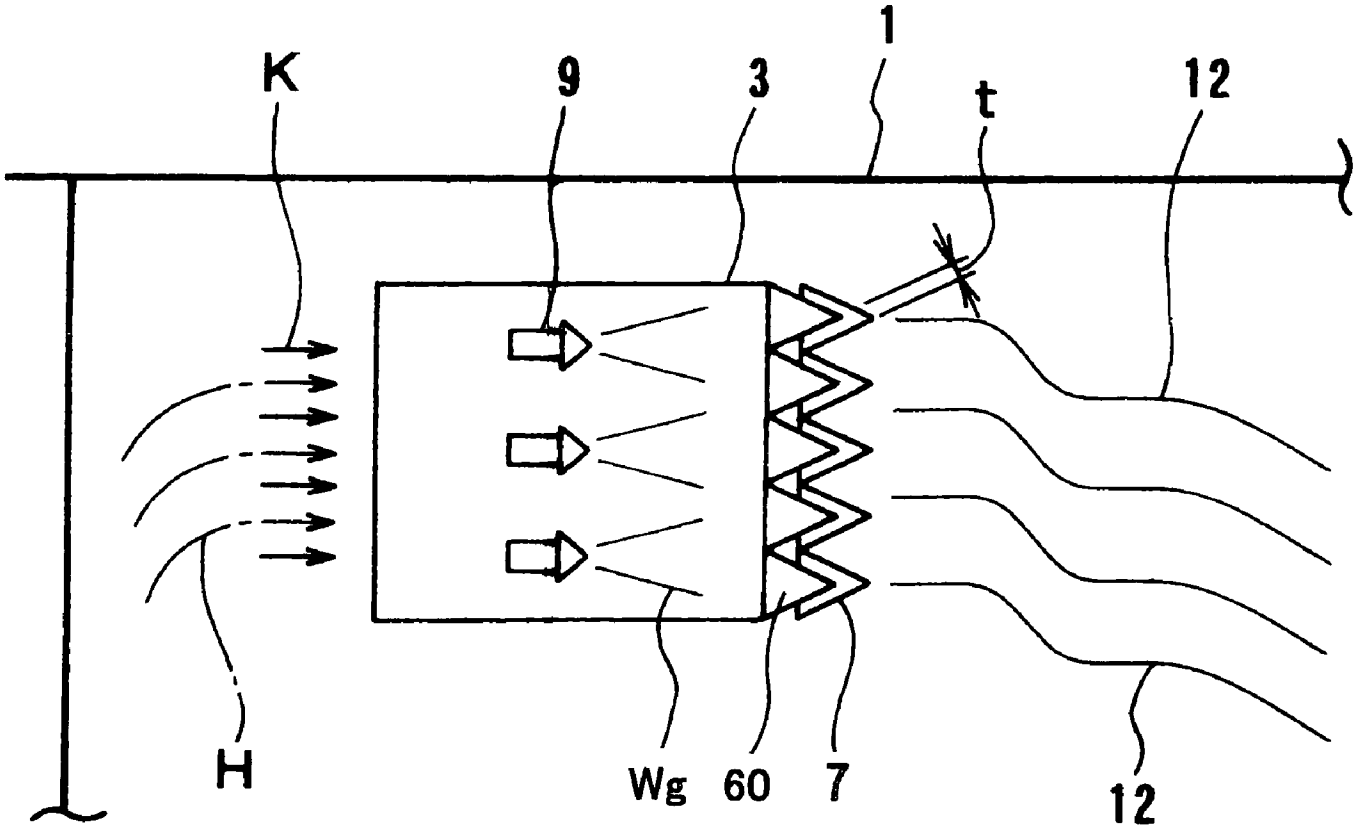
FIG. 6 is a longitudinal sectional view of a first embodiment of a third invention.

Next, a second embodiment of the third invention will be described with reference to FIGS. 8 through 10; the portions indicated by the same reference symbols as those of FIGS. 6 and 7 are the same in terms of denomination and function.

The second embodiment differs from the first embodiment in that, instead of the foam screen and the flow velocity regulating net, there is used a single velocity reduction foaming plate having a foaming function and a flow velocity regulating function.

The velocity reduction foaming plate 65 is equipped with foaming holes 65*a* with a foaming function and tubular bodies 65*b* provided on the surface (front surface) on the side opposed to the emission nozzles 9 and endowed with a flow velocity regulating function. There are provided a plurality of foaming holes 65*a*, with the tubular bodies 65*b* surrounding the foaming holes 65*a*. The size and number of the foaming holes 65*a*, the height of the tubular bodies 65*b*, etc. allow selection appropriately as needed.

In the second embodiment, the foam solution Wg ejected from the emission nozzles 9 are turned into droplets and impinge upon the tubular bodies 65*b* of the velocity reduction foaming plate 65 to be reduced in velocity. After that, the foam solution enters the foaming holes 65*a* together with the air K and absorbs the air K to thereby foam to become high expansion foam 12.

Further, the tubular bodies 65*b* cause through their hindering the droplets to drip around the foaming holes 65*a*, and increases through much dripping the chance of the droplets to foam, making it possible to form high expansion foam 12 with high efficiency.

Figure 8:
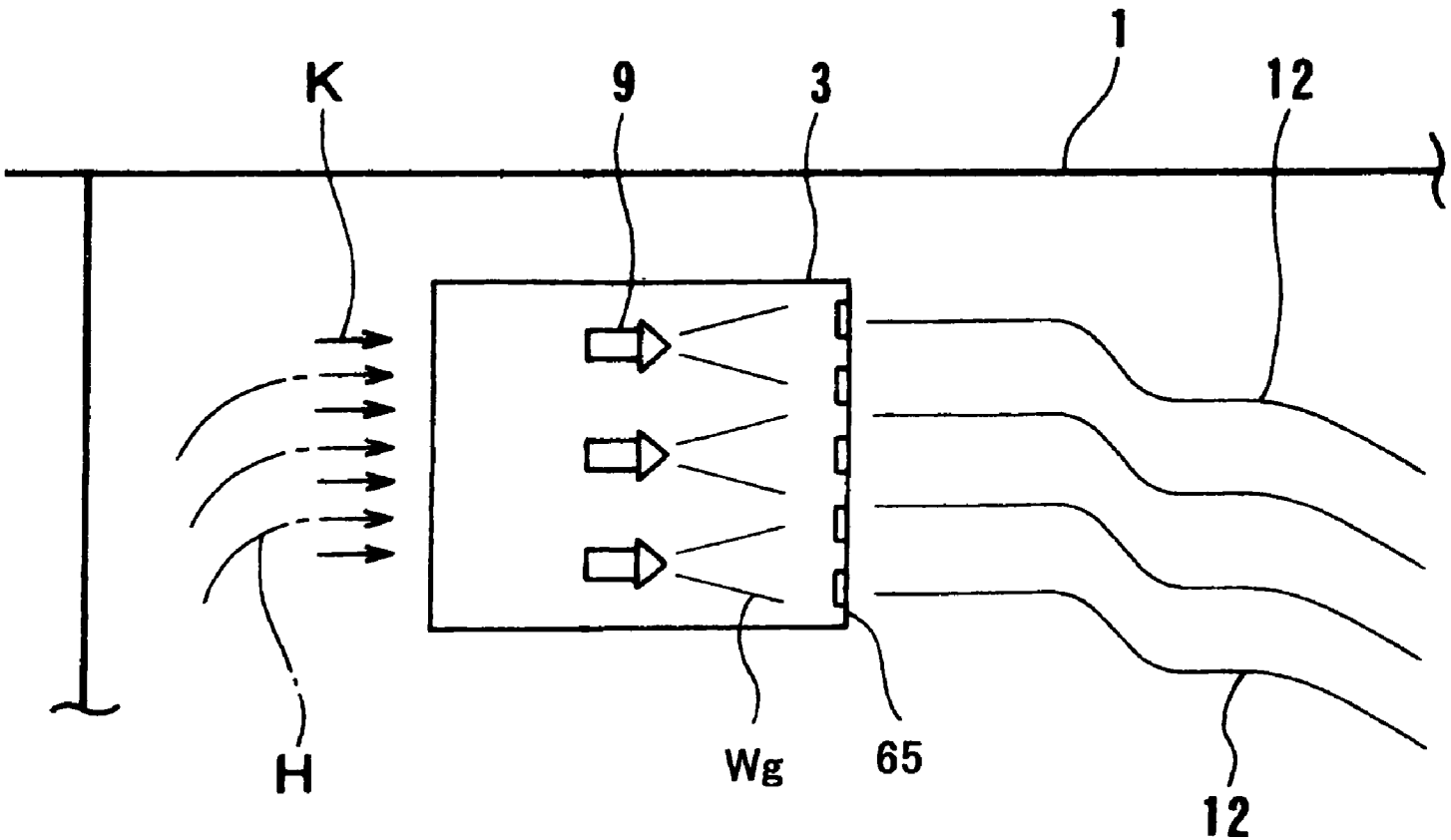
FIG. 8 is a longitudinal sectional view of a second embodiment of the third invention.
Figure 9:
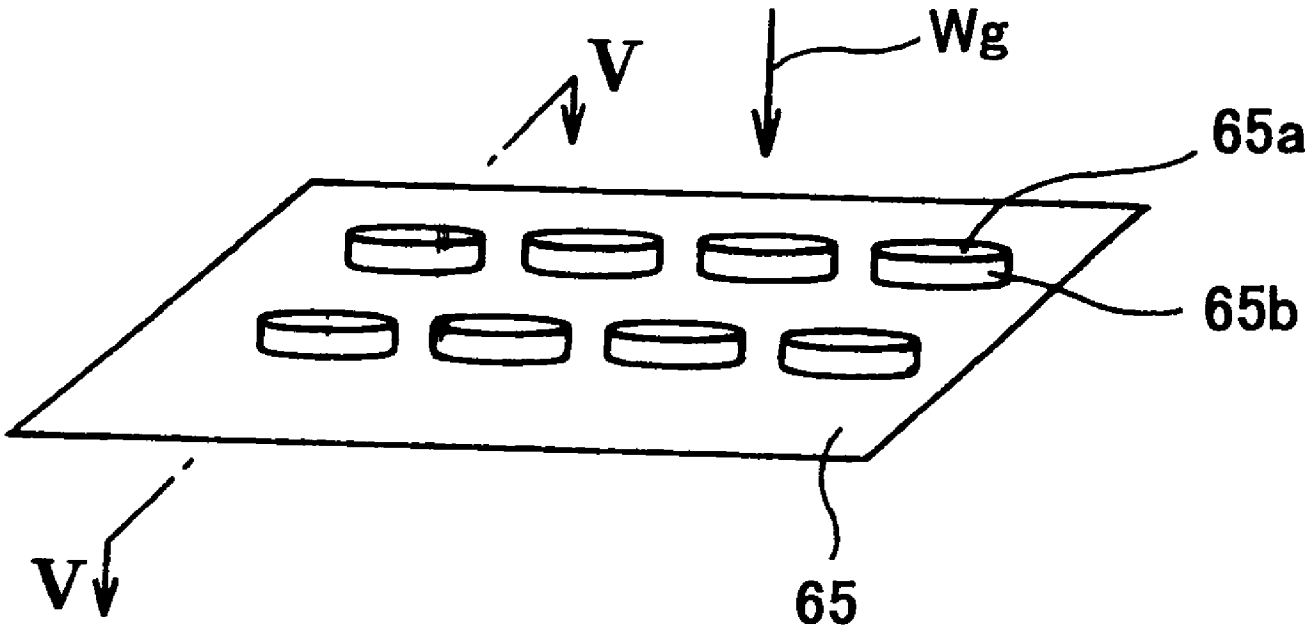
FIG. 9 is a perspective view of a velocity reduction foaming plate.
Figure 10:
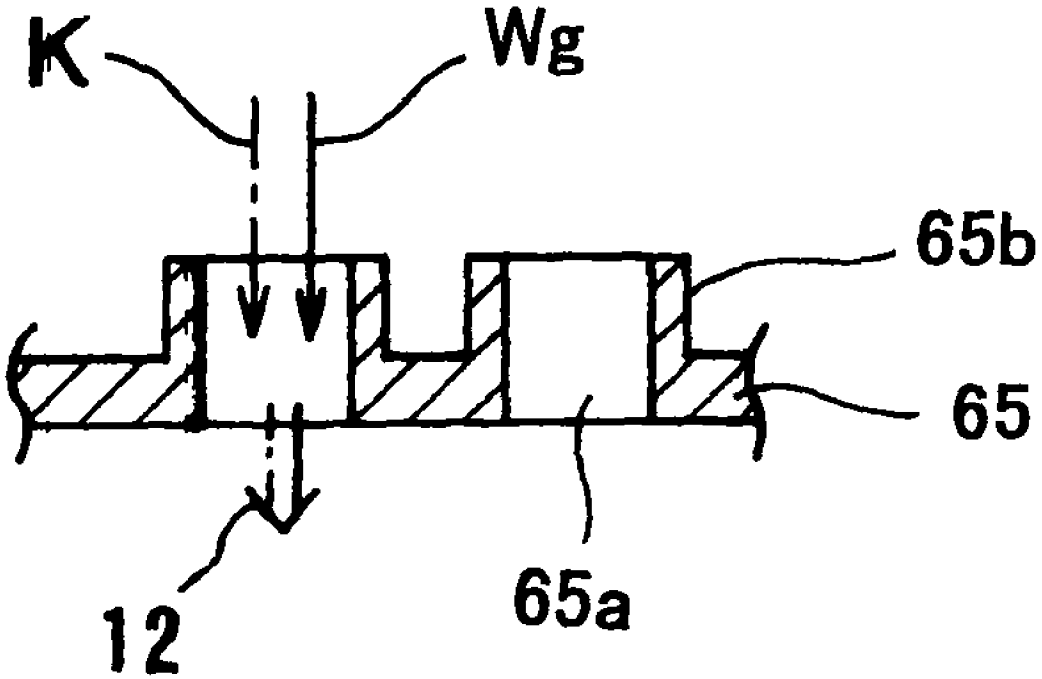
FIG. 10 is a sectional view taken along the line V-V of FIG. 9.
Figure 11:
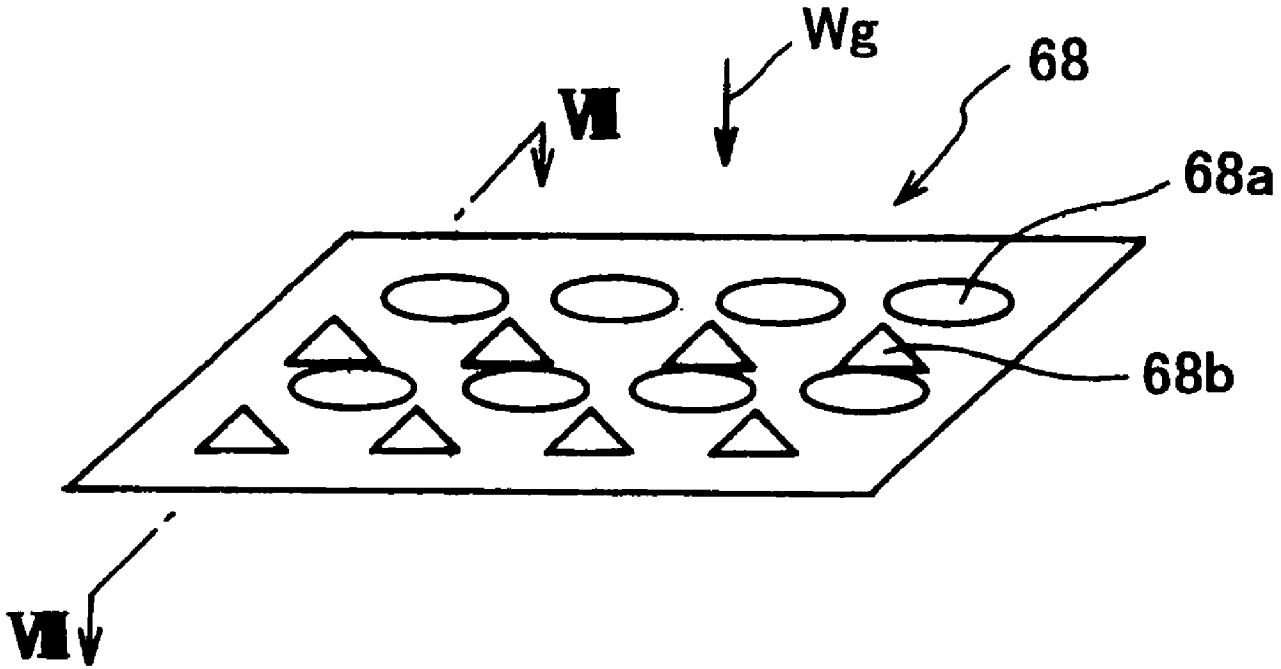
FIG. 11 is a perspective view of a velocity reduction foaming plate according to a third embodiment of the third invention.
Figure 12:
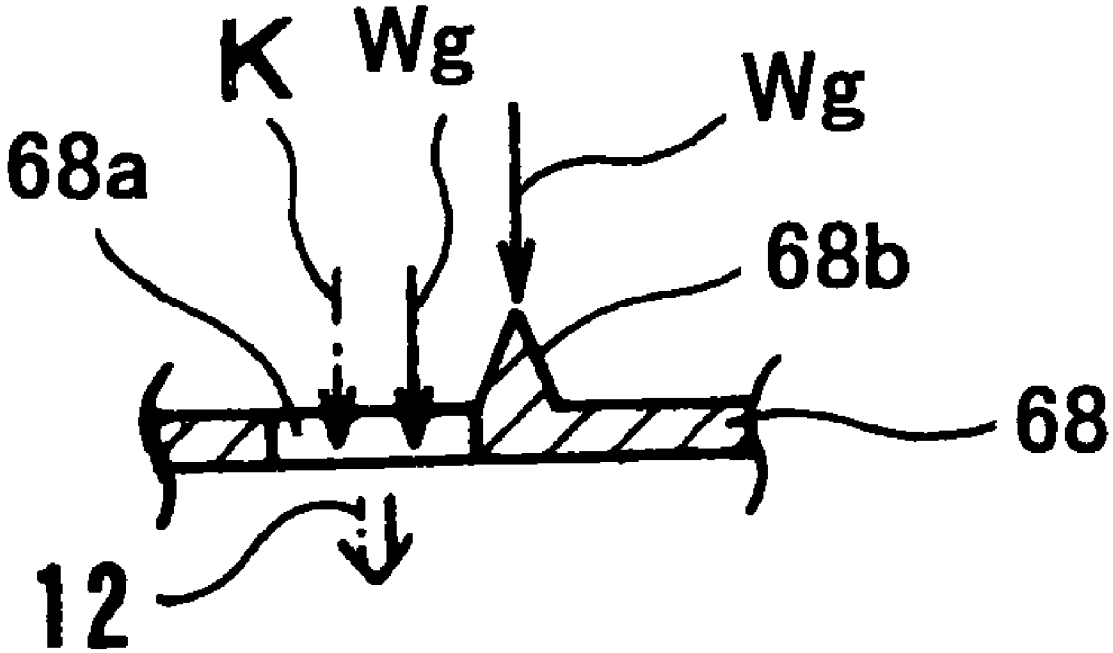
FIG. 12 is a sectional view taken along the line VII-VII of FIG. 11.

Next, a third embodiment of the third invention will be described with reference to FIGS. 11 and 12, in which the portions indicated by the same reference symbols as those of FIGS. 8 through 10 are the same in terms of denomination and function.

The third embodiment differs from the second embodiment (FIGS. 8 through 10) in that, instead of the tubular bodies, a plurality of triangular-pyramid-like protrusions 68*b* are used as the flow velocity regulating means. The positions of the plurality of protrusions 68*b* are selected appropriately as needed; for example, they are provided at the edges of the foaming holes 68*a*.

The sectional configuration of the protrusions 68*b* is not necessarily restricted to the triangular-pyramid-like one; it may also be, for example, a trapezoidal or columnar one. Further, the height of the protrusions 68*b* is selected appropriately as needed.

In the third embodiment, the foam solution Wg ejected from the emission nozzles 9 are turned into droplets and impinge upon the protrusions 68*b* of the velocity reduction foaming plate 68 to be reduced in velocity. After that, the foam solution enters the foaming holes 68*a* together with the air K and absorbs the air K to thereby foam to become high expansion foam 12.

Further, the protrusions 68*b* cause through their hindering the droplets to drip around the foaming holes 68*a*, and increases through much dripping the chance of the droplets to foam, making it possible to form high expansion foam 12 with high efficiency.

Figure 13:
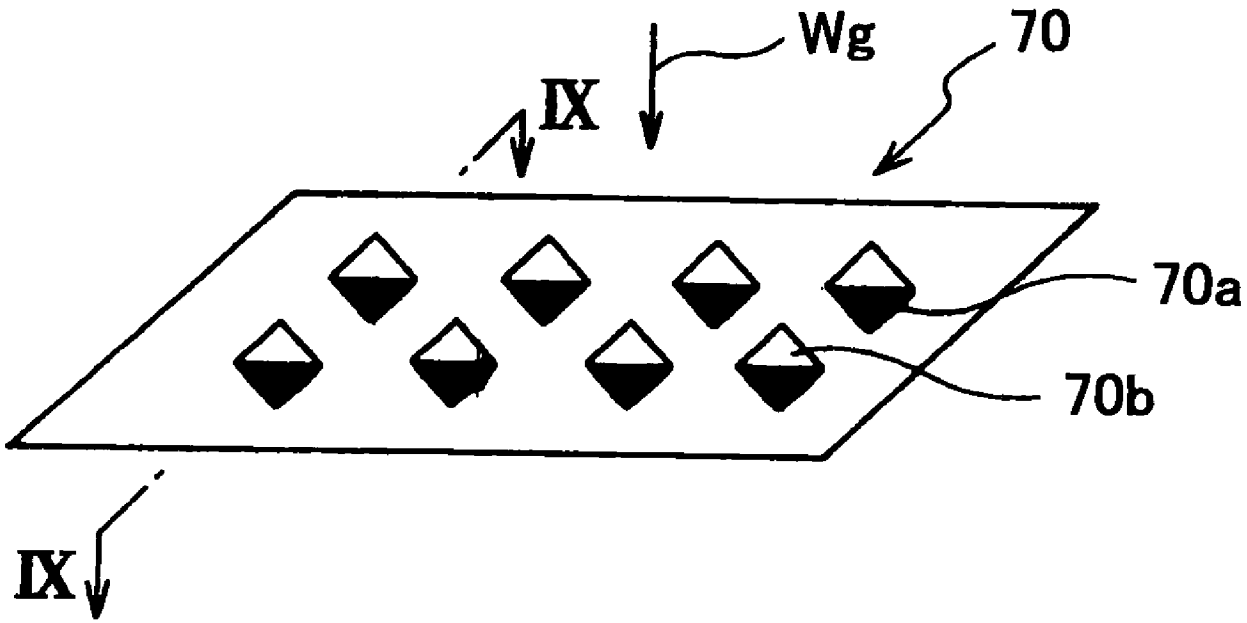
FIG. 13 is a perspective view of a velocity reduction foaming plate according to a fourth embodiment of the third invention.
Figure 14:
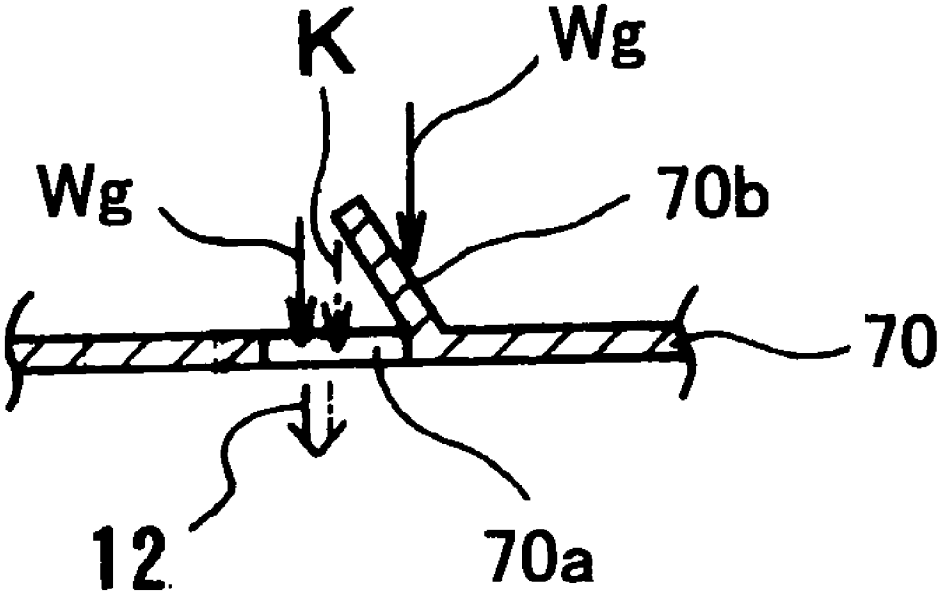
FIG. 14 is a sectional view taken along the line IX-IX of FIG. 13.

Next, a forth embodiment of the third invention will be described with reference to FIGS. 13 and 14, in which the portions indicated by the same reference symbols as those of FIGS. 8 through 10 are the same in terms of denomination and function.

The fourth embodiment differs from the third embodiment (FIGS. 11 and 12) in that, instead of the tubular bodies, there are used aperture regulating inclined members 70*b* as the flow velocity regulating means. The aperture regulating inclined members 70*b* are portions formed through cutting and raising when forming foaming holes 70*a*; their inclination angle is selected appropriately as needed.

While the foaming holes 70*a* are formed in a triangular configuration and the aperture regulating inclined members 70*b* are also formed in a triangular configuration, their configurations allow selection appropriately as needed.

In the forth embodiment, the foam solution Wg ejected from the emission nozzles 9 are turned into droplets and impinge upon the aperture regulating inclined members 70*b* of the velocity reduction foaming plate 70 to be reduced in velocity. After that, the foam solution enters the foaming holes 70*a* together with the air K and absorbs the air K to thereby foam to become high expansion foam 12.

Further, the aperture regulating inclined members 70*b* cause through their hindering the droplets to drip around the foaming holes 70*a*, and increases through much dripping the chance of the droplets to foam, making it possible to form high expansion foam 12 with high efficiency.

Figure 15:
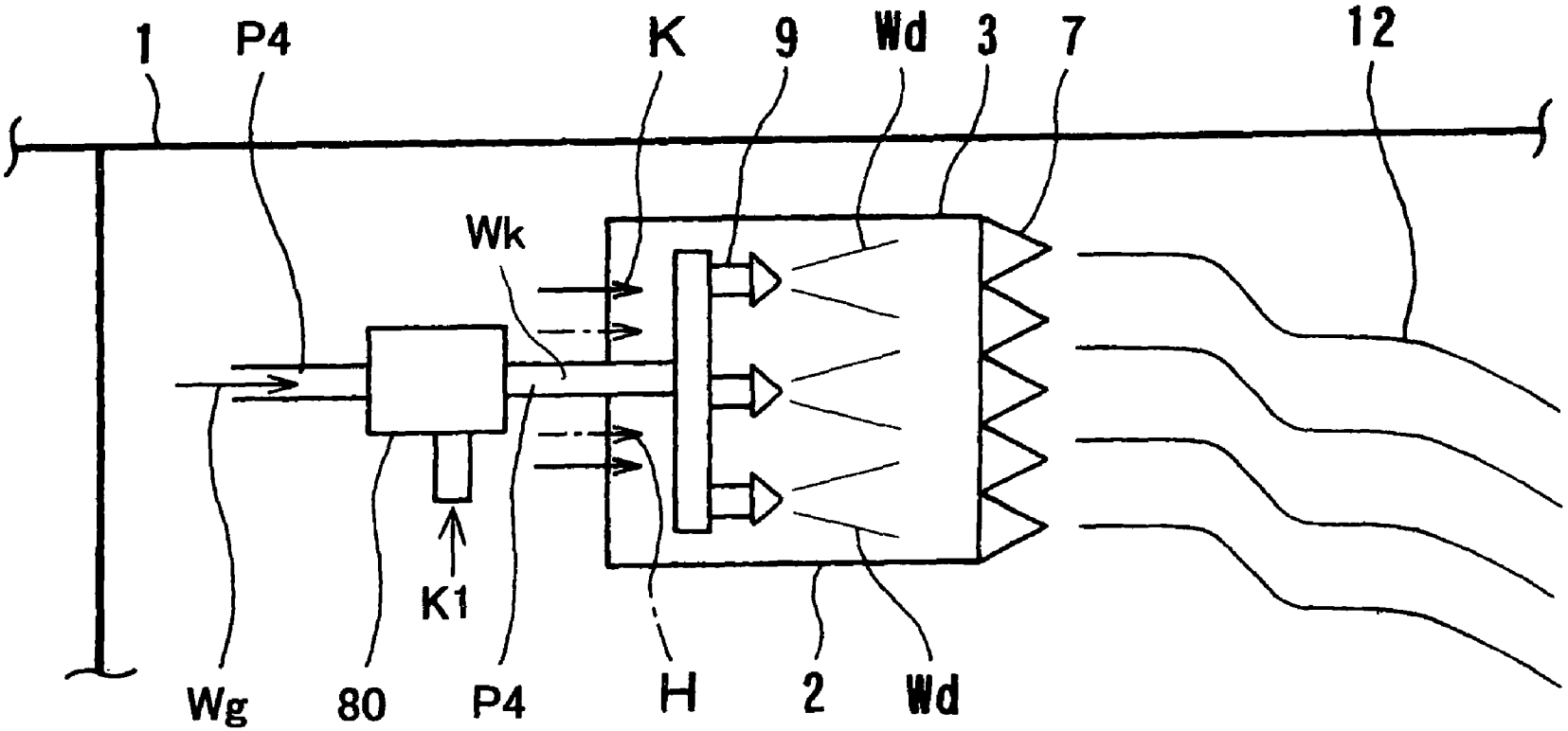
FIG. 15 is longitudinal sectional view of a first embodiment of a fourth invention.
Figure 16:
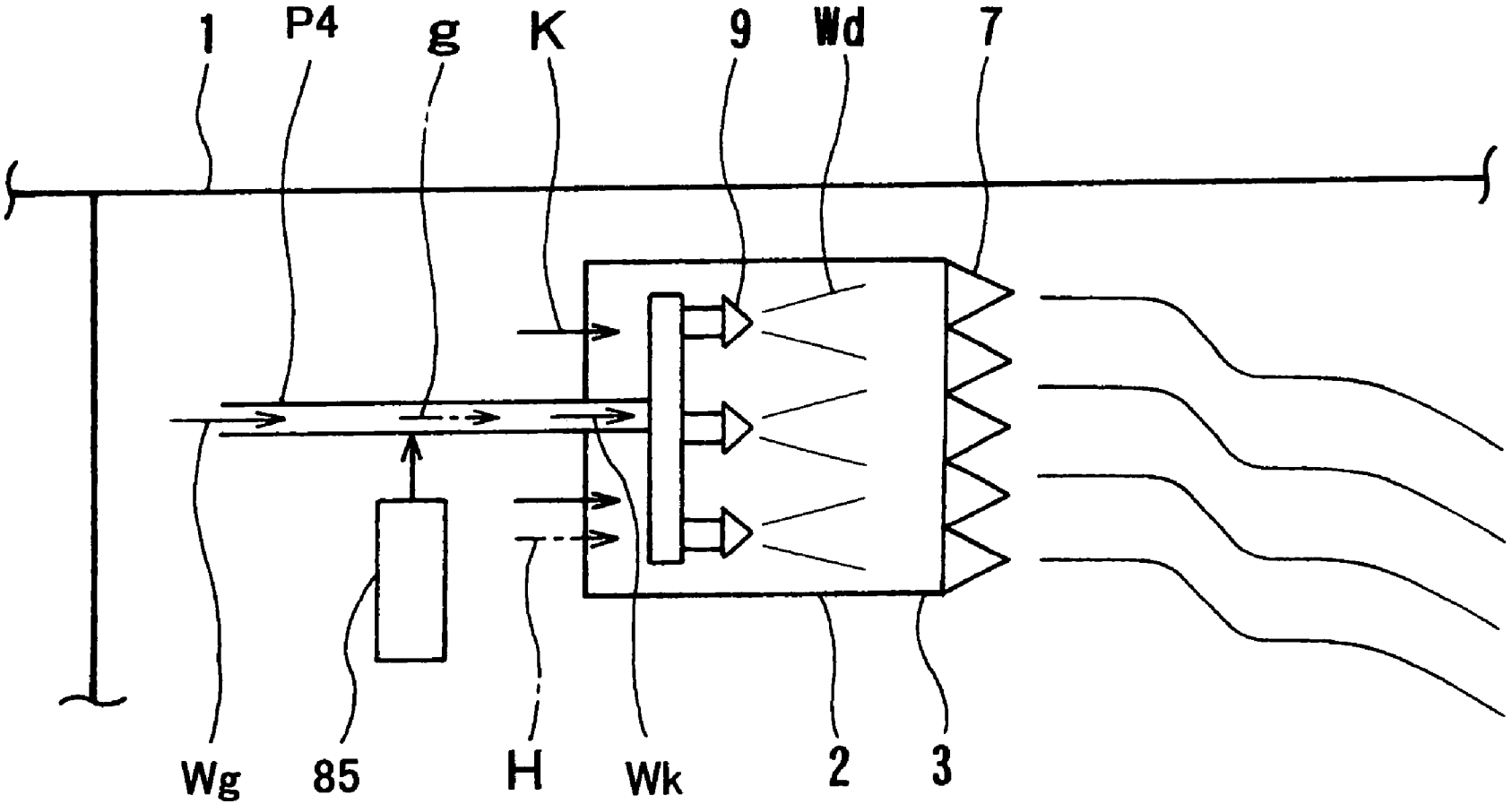
FIG. 16 is a longitudinal sectional view, corresponding to FIG. 15, of a second embodiment of the fourth invention.

As in the second invention and the third invention, in order that the amount of air sucked in and the amount of foam solution emitted may not become less than the standard set amounts, it is possible to provide the solution supply pipe P4 (solution piping P4 of FIG. 2) of the emission nozzles 9 with a mixing means for mixing air K1 or inert gas g (fourth invention). FIG. 15 is a longitudinal sectional view of a first embodiment of a fourth invention, and FIG. 16 is a longitudinal sectional view of a second embodiment of a fourth invention, with the solution supply pipe P4 being provided with an air mixing device 80 and a gas canister 85 as a mixing means.

In the fourth invention, constructed as described above, a gas-liquid mixture fluid WK is supplied to the emission nozzles 9. In the gas-liquid mixture fluid WK, the air K1 or the inert gas g is mixed with the foam solution Wg, so the density of the solution supplied to the emission nozzles 9 is lower than that when the solution supplied solely includes the solution Wg, and the number and weight of droplets Wd of the solution emitted are smaller.

Further, since the air K1 of the gas-liquid mixture fluid WK is compressed, the air K1 expands when emitted into the atmosphere, and offers resistance to the droplets Wd of the solution advancing toward the foam screen 7, so the flow velocity of the droplets Wd is reduced. Thus, the droplets Wd of the solution emitted from the emission nozzles 9 gently impinge on the foam screen 7 while reduced in velocity to a sufficient degree, so it is possible to effect foaming efficiently.

Figure 17:
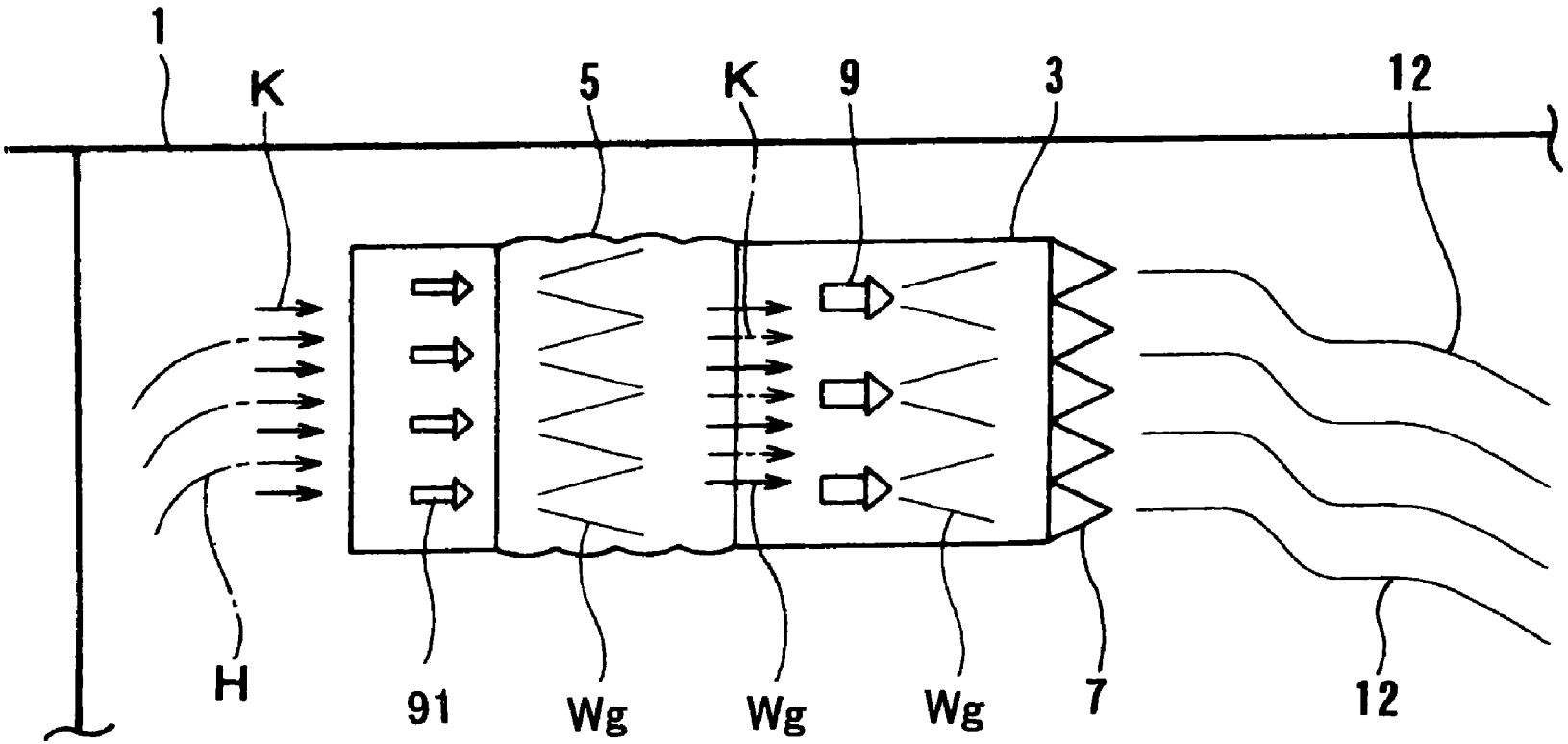
FIG. 17 is a longitudinal sectional view of an embodiment of a fifth invention.

Further, as in the second invention and the third invention, in order that the amount of air sucked in and the amount of foam solution emitted may not become less than the standard set amounts, the air sucking portion 5 for supplying the air K of the discharge area 1 to the foaming portion 3 may be provided with auxiliary nozzles 91 for increasing the amount of air K sucked in (fifth invention). FIG. 17 is a longitudinal sectional view of an embodiment of the fifth invention.

The air sucking portion 5 is formed by a duct of the same diameter as the foaming portion 3, and has on the inlet side thereof a plurality of auxiliary nozzles 91. The auxiliary nozzles 91 have a function to eject the foam solution and a function to suck the air of the discharge area 1 into the air sucking portion 5. The ejection pressure of the auxiliary nozzles 91 is set to be higher than that of the emission nozzles 9; for example, the discharge pressure of the emission nozzles 9 is set to 0.15 to 0.3 MPa, and the ejection pressure of the auxiliary nozzles 91 is set to 0.6 to 0.8 MPa.

The ejection pressure of the emission nozzles 9 is lower than the standard set pressure for normal use. Thus, the flow velocity of the solution ejected is lower than the standard set velocity, so the solution does not easily pass through the foam screen 7.

In the fifth invention, constructed as described above, the emission nozzles 9 and the auxiliary nozzles 91 are driven simultaneously, whereby, if the ejection pressure of the emission nozzles 9 is set lower than the standard set pressure, it is possible to suck a sufficient amount of air for foaming into the air sucking portion 5. Thus, as described above, it is possible to diminish the ejection pressure of the emission nozzles 9 and to make the velocity of the foam solution Wg discharged lower than the standard set velocity, so it is possible to attain a desired foam expansion ratio.

When the foam solution Wg is ejected from the auxiliary nozzles 91, the foam solution Wg impinges upon the foam screen 7 to foam. Thus, if, as the emission pressure of the emission nozzles 9 is reduced, the solution Wg ceases to be ejected, the foam solution Wg is also ejected from the auxiliary nozzles 91, so the amount of foam solution Wg supplied to the foaming portion 3 is substantially the standard amount. Thus, it is possible to obtain a desired amount of high expansion foam 12 in a predetermined time.

When the foam solution Wg and water are ejected from the auxiliary nozzles 91, smoke (fine liquid particles) existing in the sucked air is adsorbed by the droplets thereof, so it is possible to supply clean air K to the foaming portion 3.

Figure 18:
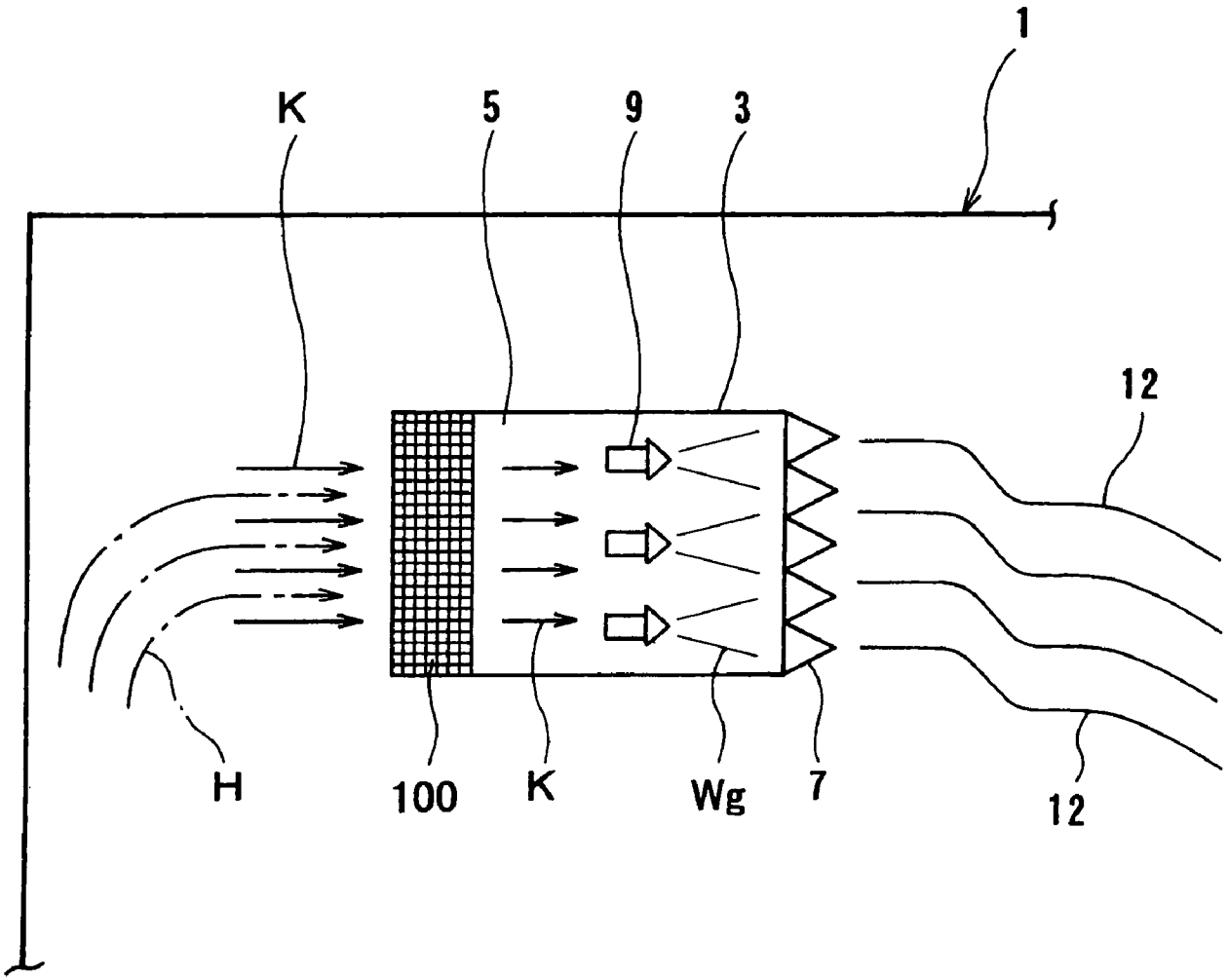
FIG. 18 is a longitudinal sectional view of an embodiment of a sixth invention.

While in the first through fifth inventions it is possible to prevent a reduction in foam expansion ratio without having to remove the smoke particles in the sucked air, it is naturally also possible for the smoke particles in the sucked air to be removed. FIG. 18 is a longitudinal sectional view of an embodiment of a sixth invention, in which the air sucking portion 5 is provided with a fine particle filter 100 for removing smoke.

In the sixth invention, constructed as described above, the smoke H in the air K sucked into the air sucking portion 5 is removed, and clean air K is supplied to the foaming portion 3. Thus, it is possible to prevent a reduction in foam expansion ratio, making it possible to perform fire-extinguishing effectively.

Figure 19:
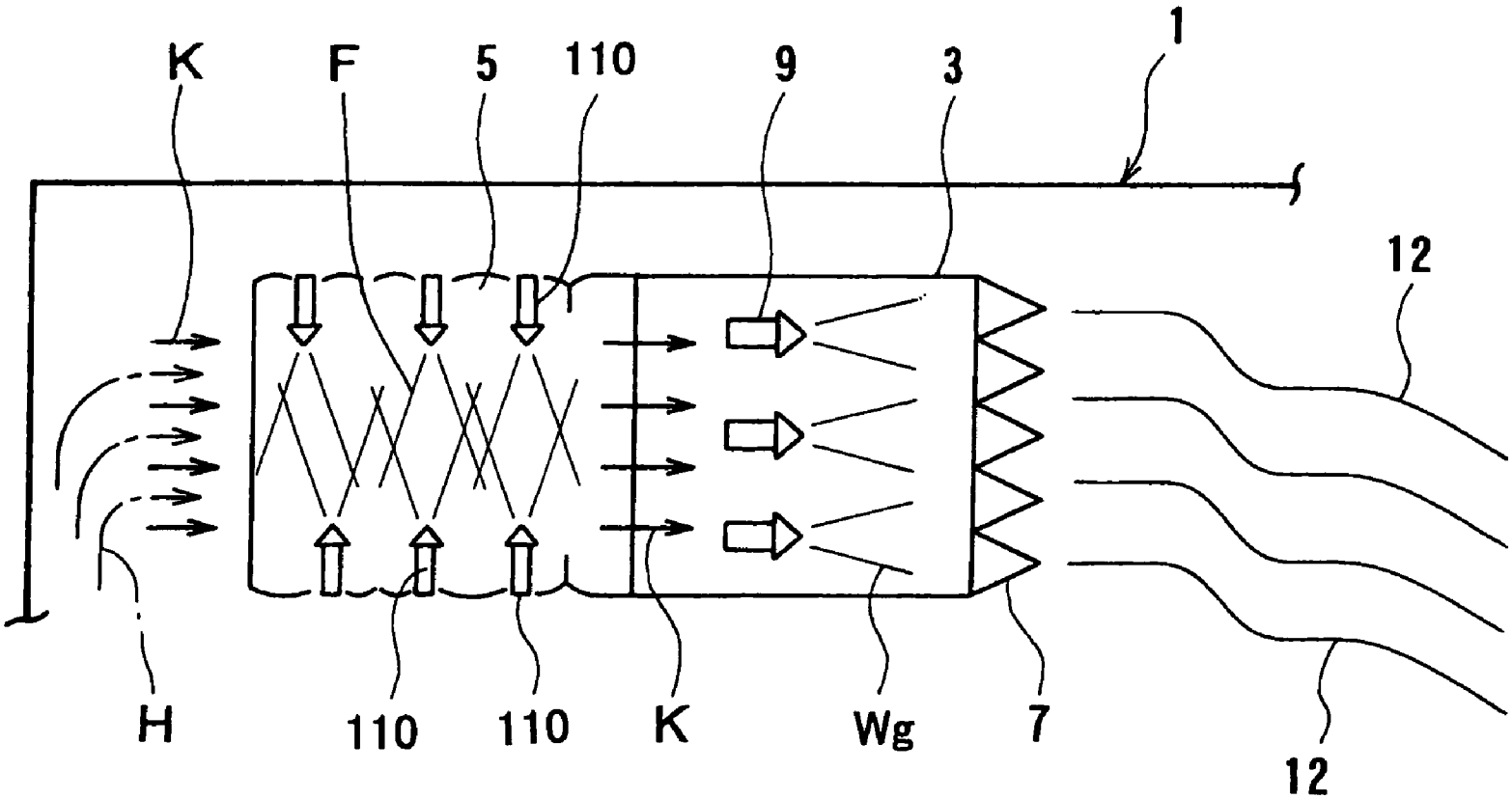
FIG. 19 is a longitudinal sectional view of an embodiment of a seventh invention.

FIG. 19 is a longitudinal sectional view of an embodiment of a seventh invention, in which cleaning spray nozzles 110 are provided inside the air sucking portion 5.

In the seventh invention, constructed as described above, the smoke H contained in the air K sucked by the air sucking portion 5, that is, the air K in the room where the air sucking portion 5 is arranged is caused to drop while adsorbed by the mist-like droplets ejected from the cleaning spray nozzles 110. Thus, it is possible to suppress a reduction in foam expansion ratio, so a stable foaming performance can be obtained, making it possible to perform fire-extinguishing effectively.

The first through seventh inventions described above may be carried out in a combination appropriately as needed.

What is claimed is:

1. A high expansion foam fire-extinguishing system provided in an enclosed space, the high expansion foam fire-extinguishing system comprising;

a supply of foam solution prepared by mixing water with a foam concentrate containing a surface active agent;

an emission nozzle to which the foam solution is supplied under pressure;

a flow passage containing the emission nozzle for sucking in air in the enclosed space including smoke generated as a result of generation of a fire by discharging the foam solution from the emission nozzle; and a foam screen which is provided in the flow passage and upon which the foam solution discharged from the emission nozzle impinges, wherein the foam concentrate comprises an aqueous film forming foam concentrate containing a fluorinated surfactant, and the foam concentrate used has a mixing ratio of the aqueous film forming foam concentrate with respect to the foam solution of 4% or more, and a content rate of the fluorinated surfactant with respect to the aqueous film forming foam concentrate of 10% or more, and wherein a mixing ratio of the surface active agent with respect to the foam solution is 0.4% or more, so as to obtain a high expansion foam having a foam expansion ratio of 240 or more.

2. The high expansion foam fire-extinguishing system according to claim 1, wherein the enclosed space is a warehouse.

3. A high expansion foam fire-extinguishing system which sucks air in a discharge area into a flow passage containing an emission nozzle, and which causes a solution discharged from the emission nozzle to impinge upon a foam screen to effect foaming, the high expansion foam fire-extinguishing system comprising a solution supply source for the emission nozzle and a plurality of spray nozzles for spraying a fluid in a direction of interrupting the flow passage to form a mist-like flow velocity regulating curtain, the spray nozzles being provided between the emission nozzle and the foam screen and arranged circumferentially at equal intervals, wherein the spray nozzles are connected to the solution supply source for the emission nozzle.

4. The high expansion foam fire-extinguishing system according to claim 3, wherein an axis of each of the spray nozzles is directed in a direction orthogonal to an axis of the flow passage.

* * * * *